US007628470B2

(12) United States Patent
Mita

(10) Patent No.: US 7,628,470 B2
(45) Date of Patent: Dec. 8, 2009

(54) LIQUID EJECTION HEAD, METHOD OF MANUFACTURING SAME, AND IMAGE FORMING APPARATUS

(75) Inventor: Tsuyoshi Mita, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 397 days.

(21) Appl. No.: 11/347,376

(22) Filed: Feb. 6, 2006

(65) Prior Publication Data

US 2006/0176344 A1 Aug. 10, 2006

(30) Foreign Application Priority Data

Feb. 7, 2005 (JP) ..... 2005-030783

(51) Int. Cl.
*B41J 2/05* (2006.01)
*B41J 2/045* (2006.01)

(52) U.S. Cl. ..... 347/58; 347/71

(58) Field of Classification Search ..... 347/68–72, 347/50, 58

See application file for complete search history.

(56) References Cited

U.S. PATENT DOCUMENTS 5,459,501 A * 10/1995 Lee et al. ..... 347/68
6,491,384 B2 * 12/2002 Usui et al. ..... 347/70
6,891,314 B2 * 5/2005 Sato et al. ..... 310/328

FOREIGN PATENT DOCUMENTS

JP 5-47771 A 2/1993
JP 6-310243 A 11/1994

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The liquid ejection head ejects droplets of liquid from ejection ports by pressurizing the liquid filled in pressure chambers connected to the ejection ports. The liquid ejection head includes a first substrate; first conducting members which are formed by spray deposition in a column shape erecting on a surface of the first substrate in a direction substantially perpendicular to the surface of the first substrate; second conducting members which have lower hardness than the first conducting members and are formed by spray deposition on ends of the first conducting members different than ends connecting with the surface of the first substrate, pairs of the first conducting members and the second conducting members composing column-shaped electrical wires; a second substrate which is bonded to ends of the second conducting members different than ends connecting with the first conducting members; and pressure generating elements which are formed on one of the first substrate and the second substrate, the pressure generating elements being connected to the electrical wires and generating pressure change in the liquid inside the pressure chambers by being driven by drive signals applied through the electrical wires.

11 Claims, 18 Drawing Sheets

FIG.4

HARDNESS OF PLATING METAL AND NORMAL METAL

| METAL | ANNEALED | ROLLED | CAST | PLATING |
|---|---|---|---|---|
| BRASS | 60 | — | — | — |
| COPPER | 130 | — | — | — |
| SILVER | 25 | 68 | 30 | 61~79 (MATT) |
| SILVER | — | — | — | 130 (GLOSSY) |
| PLATINUM | 47 | 97 | 50 | 606~642 |
| PALLADIUM | 48 | 109 | 52 | 387~435 |
| PALLADIUM | — | — | — | (HARD) 190~196 |
| RHODIUM | 101 | — | 101 | (SOFT) 594~641 |
| NICKEL | 70~90 | 90~300 | 70~90 | 155~429 |
| CHROME | — | — | 91 | 500~900 |

HARDNESS: BRINELL HARDNESS

SOURCE: http://www.tmk.or.jp/data/data16.html

LIQUID EJECTION HEAD, METHOD OF MANUFACTURING SAME, AND IMAGE FORMING APPARATUS

BACKGROUND OF THE INVENTION

1. Field of the Invention

The present invention relates to a liquid ejection head, a method of manufacturing same, and an image forming apparatus, and more particularly, to a structure of a liquid ejection head in which a plurality of ejection ports (nozzles) are arranged at high density, a method of manufacturing same, and an image forming apparatus, such as an inkjet recording apparatus, which forms an image on a recording medium by using this liquid ejection head.

2. Description of the Related Art

An inkjet recording apparatus is an apparatus for forming images by means of ink dots, by causing ink to be ejected from a print head (recording head) comprising nozzles for ejecting ink, in accordance with a print signal (image signal), thereby depositing ink droplets on a recording medium, such as recording paper, or the like, while moving the recording medium relatively with respect to the print head.

A general print head has a structure in which ink is supplied to a pressure chamber connected to a nozzle, and by driving a driving element of the pressure chamber (a pressure generating element constituted by a piezoelectric element or a heating element), a pressure variation is applied to the liquid in the pressure chamber and a liquid droplet is thereby ejected from the nozzle. There are various concrete modes of a print head, and in many cases, the print head is fabricated by laminating and bonding a plurality of thin plate-shaped (or thin film-shaped) members, such as plate members for forming flow channels, a drive element layer, and a wiring substrate, and the like.

In recent years, there have been demands for image formation of high quality equivalent to photographic prints in the field of inkjet printing, and it has been attempted to achieve image output of high resolution by reducing the volume of the ejected liquid droplets and increasing the density of the nozzle arrangement. However, in order to increase the density of the nozzles, it is essential to devise the electrical wiring of the drive elements and the composition of the ink flow channels, suitably. In the field of installation technology in electrical circuits, with the compactification of elements and the increasing density of installation, methods for forming bumps and connectors of junction sections are formed by a gas deposition method (see Japanese Patent Application Publication Nos. 547771 and 6-310243).

In the manufacturing of a print head, external force (bonding pressure) is applied in the direction of lamination when certain parts of the structure are superimposed with the other plate-shaped parts and bonded with same. If structural parts having a relatively high rigidity are bonded to members of low rigidity (such as a piezoelectric film), and the like, then damage may be caused to the members such as the thin film on the bonded side, due to the pressure exerted during bonding.

For example, supposing a case where column-shaped electrical wiring members are bonded onto the upper surface electrodes of the piezoelectric elements, since the piezoelectric body layer is made of ceramic, the layer is weak with respect to applied pressure, and especially if it is made of a thin film, then it is possible that cracks may occur in the piezoelectric body layer due to the bonding pressure, and in the worst case scenario, the piezoelectric element may break.

SUMMARY OF THE INVENTION

The present invention has been contrived in view of the foregoing circumstances, an object thereof being to provide a structure of a liquid ejection head, and a method of manufacturing same, whereby the connection reliability during bonding is improved, and a further object thereof being to provide an image forming apparatus comprising this liquid ejection head.

In order to attain the aforementioned object, the present invention is directed to a liquid ejection head which ejects droplets of liquid from ejection ports by pressurizing the liquid filled in pressure chambers connected to the ejection ports, the liquid ejection head comprising: a first substrate; first conducting members which are formed by spray deposition in a column shape erecting on a surface of the first substrate in a direction substantially perpendicular to the surface of the first substrate; second conducting members which have lower hardness than the first conducting members and are formed by spray deposition on ends of the first conducting members different than ends connecting with the surface of the first substrate, pairs of the first conducting members and the second conducting members composing column-shaped electrical wires; a second substrate which is bonded to ends of the second conducting members different than ends connecting with the first conducting members; and pressure generating elements which are formed on one of the first substrate and the second substrate, the pressure generating elements being connected to the electrical wires and generating pressure change in the liquid inside the pressure chambers by being driven by drive signals applied through the electrical wires.

According to the present invention, since column-shaped first conducting members are formed on the first substrate by spray deposition, pressurized connection by bonding is not required for the electrical connections between the first substrate and the first conducting members, and hence the number of contact points subjected to application of an external force is reduced. Furthermore, since column-shaped electrical wires are constituted by forming second conducting members of relatively low hardness on the first conducting members, by means of spray deposition, and since the second conducting members of the electrical wires are bonded to (installed on) the second substrate, then the second conducting members in the junction sections (installation sections) have the effect of reducing the pressure applied during bonding, and therefore it is possible to prevent deformation of the first and second substrates due to the external force (bonding pressure). Accordingly, it is possible to improve the reliability of connection.

The spray deposition method is a technique which forms a film by depositing a material by blowing powder of the material onto a substrate at high speed, and it is also called "aerosol deposition" or "gas deposition" (hereinafter referred to as "aerosol deposition" or "AD"). The aerosol deposition is beneficial in that it allows easier formation of thick films, compared to other deposition techniques, such as sputtering, and furthermore, it makes it possible to preserve the crystalline structure of the powder starting material. When the aerosol deposition is used, it is possible to readily form conducting films of different hardnesses by changing the film formation conditions, and it is also possible to readily form graduated structures in which the hardness or composition changes gradually.

In the present invention, piezoelectric elements (piezoelectric actuators) or heating elements (heaters), or the like, are used as pressure generating device for generating ejection pressure. Furthermore, there are no particular restrictions on the number of ejection ports and the mode of arrangement of these ports in the liquid ejection head, and a mode having a nozzle row in which a plurality of ejection ports are arranged one-dimensionally, or a nozzle row in which a plurality of ejection ports are arranged two-dimensionally, may be adopted.

Preferably, the second conducting members are formed from a material including one of copper, aluminum, silver, and gold.

From the viewpoint of installation characteristics, a mode where the second conducting members are formed by using a metal material classified as a soft metal is desirable.

Preferably, the liquid ejection head further comprises: a common liquid chamber which is formed between the first substrate and the second substrate and accumulates the liquid to be supplied to the pressure chambers, wherein peripheral parts of the first conducting members and the second conducting members are coated with an insulating film.

According to this mode, since the pressure chambers can be arranged two-dimensionally at high density, it is possible to achieve high density of the ejection ports, and furthermore, the strength of the head can be ensured by the structure of the column-shaped electrical wires constituted by the first conducting members and the second conducting members. Furthermore, by covering the liquid-contacting surfaces of the electrical wires with an insulating film, it is possible to ensure liquid resistance properties.

Preferably, the pressure generating elements comprise piezoelectric elements including piezoelectric bodies formed by spray deposition.

By forming piezoelectric elements which function as pressure generating elements, by spray deposition, an integrated process using the same film fabrication chamber becomes possible, and therefore the manufacturing process can be simplified and costs can be reduced.

In order to attain the aforementioned object, the present invention is also directed to a method of manufacturing a liquid ejection head which ejects droplets of liquid from ejection ports by pressurizing the liquid filled in pressure chambers connected to the ejection ports, the method comprising the steps of: forming pressure generating elements on one of a first substrate and a second substrate, the pressure generating elements generating pressure change in the liquid inside the pressure chambers; forming column-shaped first conducting members, by spray deposition, erecting on a surface of the first substrate in a direction substantially perpendicular to the surface of the first substrate; forming second conducting members having lower hardness than the first conducting members, by spray deposition, on ends of the first conducting members different than ends connecting with the surface of the first substrate, pairs of the first conducting members and the second conducting members composing column-shaped electrical wires; and bonding the second substrate to ends of the second conducting members different than ends connecting with the first conducting members, and enabling the pressure generating elements to be driven by drive signals applied through the electrical wires.

In order to attain the aforementioned object, the present invention is also directed to an image forming apparatus, comprising the above-described liquid ejection head, which forms an image on a recording medium by the droplets of the liquid ejected from the ejection ports.

For example, the liquid ejection head used in this image forming apparatus achieves a prescribed dot arrangement by causing liquid droplets to be ejected from the liquid ejection ports (nozzles) by controlling the pressure generating elements (piezoelectric elements or heating elements) on the basis of image data.

A compositional embodiment of a liquid ejection head is a full line type inkjet head having a nozzle row in which a plurality of nozzles for ejecting ink are arranged through a length corresponding to the full width of the recording medium.

In this case, a mode may be adopted in which a plurality of relatively short ejection head modules having nozzles rows which do not reach a length corresponding to the full width of the recording medium are combined and joined together, thereby forming nozzle rows of a length that correspond to the full width of the recording medium.

A full line type inkjet head is usually disposed in a direction that is perpendicular to the relative feed direction (relative conveyance direction) of the recording medium, but a mode may also be adopted in which the inkjet head is disposed following an oblique direction that forms a prescribed angle with respect to the direction perpendicular to the conveyance direction.

When forming color images, it is possible to provide full line type print heads for each color of a plurality of colored inks, or it is possible to eject recording inks of a plurality of colors, from one print head.

"Recording medium" indicates a medium on which an image is recorded by means of the action of the liquid ejection head (this medium may also be called an ejection receiving medium, print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

The movement device for causing the recording medium and the liquid ejection head to move relatively to each other may include a mode where the recording medium is conveyed with respect to a stationary (fixed) liquid ejection head, or a mode where a liquid ejection head is moved with respect to a stationary recording medium, or a mode where both the liquid ejection head and the recording medium are moved.

According to the present invention, it is possible to reduce the applied pressure in the junction sections by means of the second conducting members of low hardness, at the same time as ensuring necessary rigidity in the structural body by means of the first conducting members constituting the column-shaped electrical wires. Furthermore, since the number of contact points is reduced by adopting a spray deposition method, it is possible to ensure the reliability of connections, in conjunction with the action of the second conducting members in the junction sections.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 4 is a table showing the hardness of plating metals and normal metals;

DETAILED DESCRIPTION OF THE PREFERRED EMBODIMENTS

Figure 1:
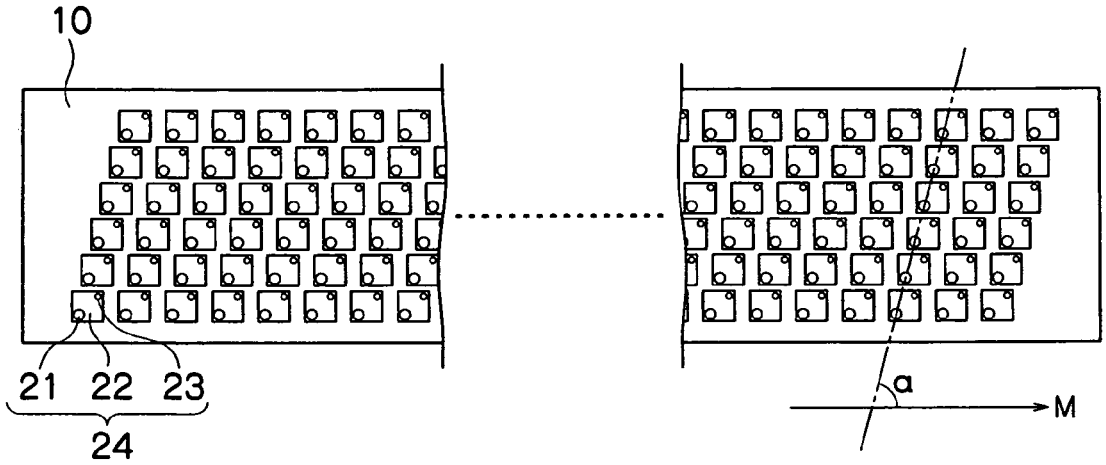
FIG. 1 is a plan view perspective diagram of an inkjet type print head showing an embodiment of a liquid ejection head according to the present invention.
Figure 2:
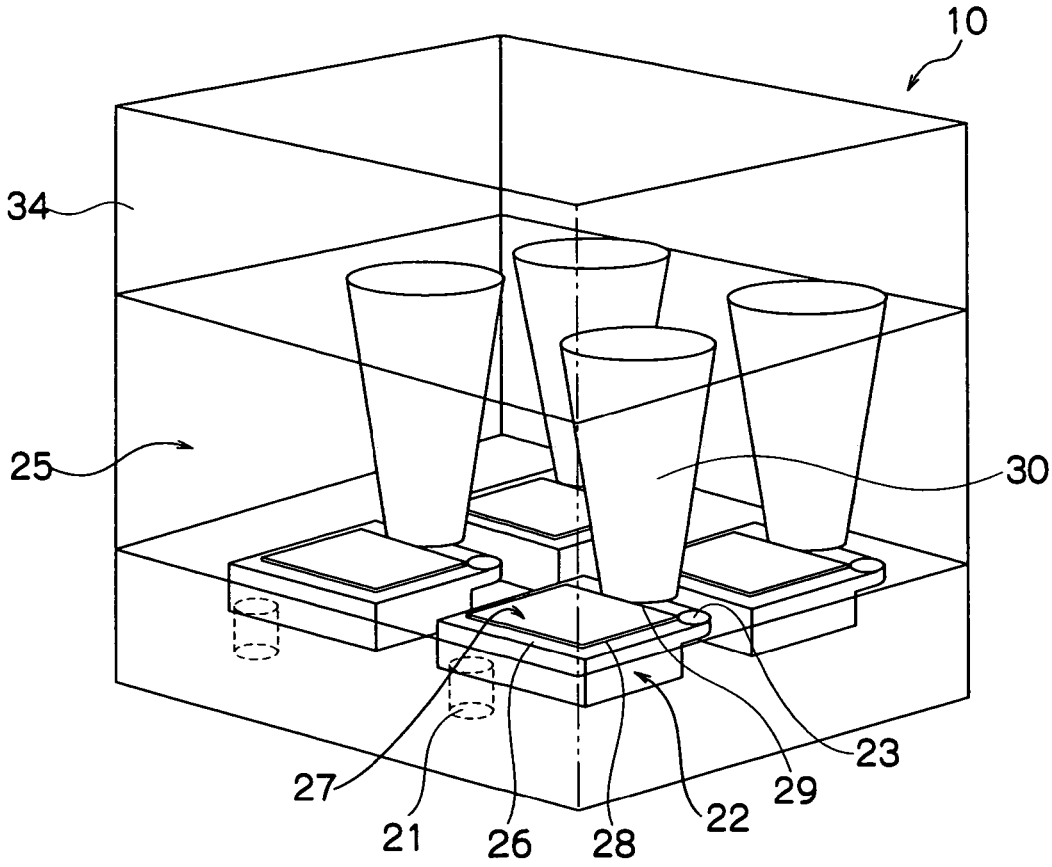
FIG. 2 is an oblique perspective diagram showing a schematic view of a portion of the print head shown in FIG. 1.

FIG. 1 is a plan view perspective diagram of an inkjet print head (hereinafter simply referred to as a "print head") 10 showing an embodiment of a liquid ejection head according to the present invention, and FIG. 2 is an oblique perspective diagram showing a schematic view of a portion of the print head 10.

Structure of the Print Heads

As shown in FIG. 1, this print head 10 has a structure in which a plurality of pressure chamber units (liquid droplet ejection elements) 24 are arranged in a matrix configuration two-dimensionally. Each of the pressure chamber units 24 comprises a nozzle 21 for ejecting ink as a liquid droplet, a pressure chamber 22 corresponding to each nozzle 21, and an independent supply port 23 for supplying ink to the corresponding pressure chamber 22 from a common liquid chamber 25 (not shown in FIG. 1, but shown in FIG. 2).

The planar shape of the pressure chamber 22 provided corresponding to each nozzle 21 is substantially a square shape, and an outlet port to the nozzle 21 is provided at one of the ends of the diagonal line of the planar shape, while the independent supply port 23 is provided at the other end thereof. The shape of the pressure chamber 22 is not limited to that of the present embodiment and various modes are possible in which the planar shape is a quadrilateral shape (rhombic shape, rectangular shape, or the like), a pentagonal shape, a hexagonal shape, or other polygonal shape, or a circular shape, elliptical shape, or the like.

By adopting a composition in which a plurality of pressure chamber units 24 having the composition described above are arranged in a lattice configuration according to a fixed arrangement pattern following a row direction in line with the lengthwise direction of the head (the direction of arrow M in FIG. 1), and an oblique column direction having a fixed non-perpendicular angle $\alpha$ with respect to the row direction, then high-density nozzle rows are achieved in which the effective nozzle pitch (projected nozzle pitch) when projected to an alignment in the lengthwise direction of the head (direction of arrow M) is a narrow pitch.

As shown in FIG. 2, in the print head 10 of the present embodiment, a diaphragm 26 forming portions of the pressure chambers 22 (the ceilings in FIG. 2) is disposed on the upper sides of the pressure chambers 22 having the nozzles 21 and the independent supply ports 23. Piezoelectric elements 28 forming drive elements (pressure generating devices) are disposed on the portions of the diaphragm 26 corresponding to the pressure chambers 22. The diaphragm 26 also serves as a common electrode (lower electrode) of the piezoelectric elements 28.

An individual electrode (upper electrode) 27 is provided on the upper surface of each of the piezoelectric elements 28, and an electrode pad 29 forming an electrode connecting section extends from the side end section of the individual electrode 27 to the exterior of the pressure chamber 22. An electrical wire 30 is formed in a column shape standing in a substantially perpendicular direction on the electrode pad 29. A multi-layer wiring substrate 34 is disposed on the upper end sections of the electrical wires 30, and drive signals are applied from the head driver (not shown) to the individual electrodes 27 of the piezoelectric elements 28 through the electrical wires 30, so that the piezoelectric elements 28 can be driven independently from each other. The wiring substrate 34 is an installation substrate on which an integrated circuit (IC) or the like (not shown) is installed, and it may be implemented by a rigid substrate, a flexible substrate, or a combination of these substrates.

The space between the diaphragm 26 and the wiring substrate 34 (the space formed by the standing column-shaped electrical wires 30) forms the common liquid chamber 25, which pools the ink to be supplied to the pressure chambers 22. In other words, the electrical wires 30 are formed in such a manner that they erect from the electrode pads 29 in a substantially perpendicular direction with respect to the surface of the diaphragm 26, thereby passing through the common liquid chamber 25. The independent supply ports 23 connecting to the pressure chambers 22 are formed on the diaphragm 26, and the ink is supplied to the pressure chambers 22 from the common liquid chamber 25 through the independent supply ports 23.

The common liquid chamber 25 shown here is one large space formed throughout the whole region where the pressure chambers 22 are formed, in such a manner that the common liquid chamber 25 supplies the ink to all of the pressure chambers 22 shown in FIG. 1; however, the common liquid chamber 25 is not limited to being formed into one space, and a plurality of chambers may be formed by dividing up (splitting) the space into a plurality of regions.

The electrical wires 30 of the present embodiment are independently formed with respect to the piezoelectric elements 28, in a one-to-one correspondence; however, in order to reduce the number of the column-shaped electrical wires 30, it is also possible to make one column correspond to a plurality of piezoelectric elements 28, in such a manner that the electrical wires 30 corresponding to several piezoelectric elements 28 are gathered together and formed into a single column. Moreover, in addition to the wiring to the individual electrodes 27, it is also possible to connect wiring having a column-shaped structure similar to that of the electrical wires 30, such as wiring to the common electrode (diaphragm 26), signal wiring from a sensor unit (not shown, for example, a pressure sensor provided on the pressure chamber 22), or the like.

Figure 3:
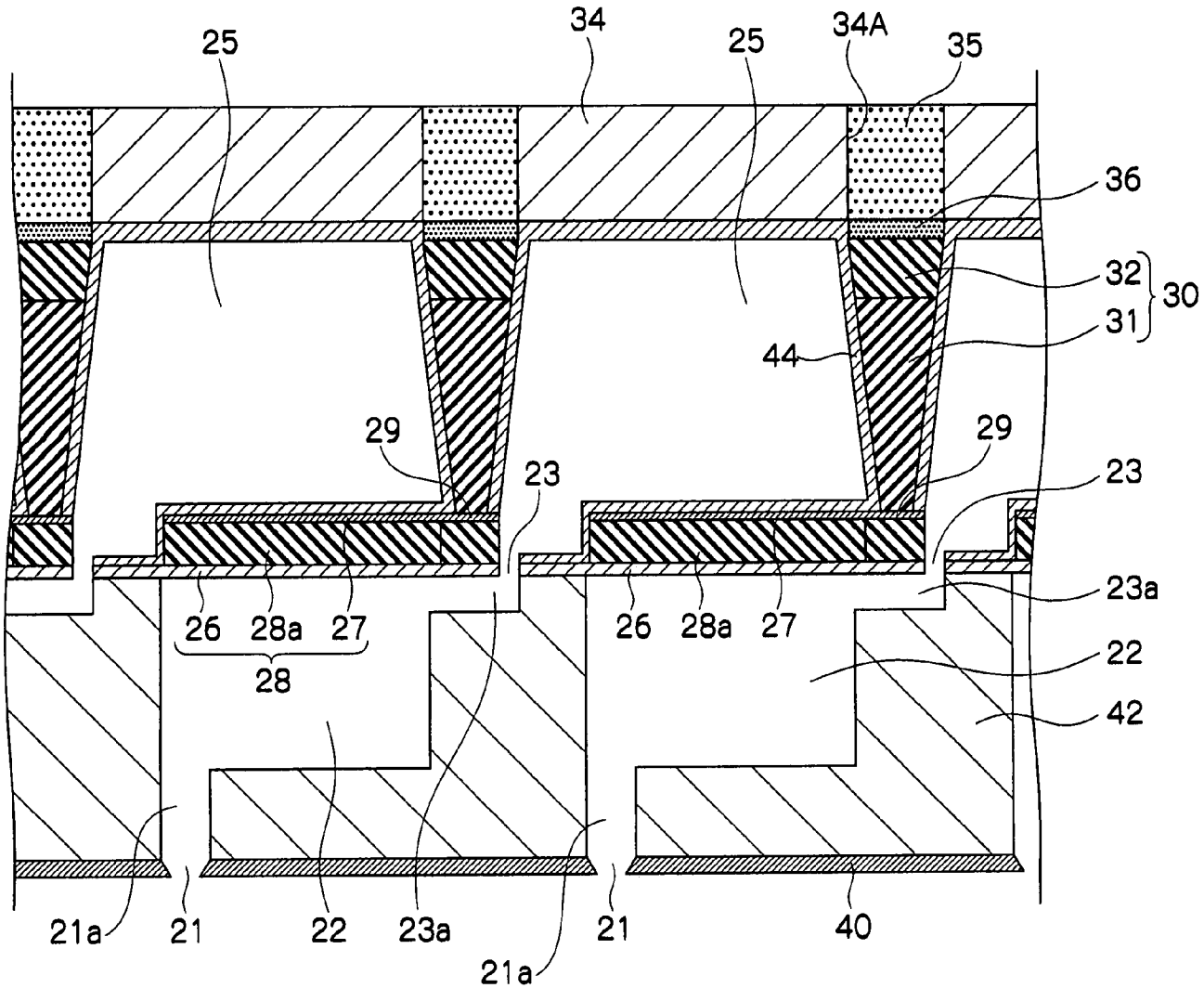
FIG. 3 is a cross-sectional diagram showing an enlargement of a portion of the print head according to the present embodiment.

FIG. 3 is a cross-sectional diagram showing an enlarged view of a portion of the print head 10. The nozzles 21 (ejection ports) are formed as holes in a nozzle plate 40. The pressure chambers 22, nozzle flow channels 21*a* and supply flow channels 23*a*, and the like, are formed in a flow channel plate 42. The flow channel plate 42 is depicted as a single plate in FIG. 3; however, the flow channel plate 42 may also be formed by laminating together a plurality of plates.

The diaphragm 26 is laminated onto the flow channel plate 42. As described previously, opening sections corresponding to the independent supply ports 23 are provided in the diaphragm 26, and the common liquid chamber 25 and the pressure chambers 22 are connected directly through the opening sections (independent supply ports 23). Since the common liquid chamber 25 is filled with the ink, then the surfaces (liquid contacting surfaces) of the diaphragm 26, the individual electrodes 27, the electrical wires 30 and the wiring substrate 34 that make contact with the ink are covered with an insulating protective film 44 having liquid resistant characteristics.

Piezoelectric bodies 28*a* are provided on the upper surface (the side reverse to the pressure chambers 22) of the diaphragm 26 in the sections corresponding to the planar shapes of the pressure chambers 22, and the individual electrode 27 is formed on the upper surface of each of the piezoelectric bodies 28*a*. The piezoelectric element 28 is composed of the common electrode corresponding to the lower electrode (which also serves as the diaphragm 26 in the present embodiment), the individual electrode 27 corresponding to the upper electrode, and the piezoelectric body 28*a* sandwiched between these electrodes, and function as an actuator for generating pressure in the pressure chamber 22.

When a drive voltage is applied between the common electrode and the individual electrode 27, the piezoelectric body 28*a* deforms, thereby changing the volume of the pressure chamber 22. This causes a pressure change that results in the ink being ejected from the nozzle 21. A piezoelectric material, such as lead titanate zirconate or barium titanate is suitable for use as the piezoelectric body 28*a*. When the piezoelectric body 28*a* returns to its original position after ejecting the ink, new ink is supplied to the pressure chamber 22 from the common liquid chamber 25 through the independent supply port 23.

By adopting the structure in which the common liquid chamber 25 is disposed on the upper side of the diaphragm 26 (on the reverse side to the pressure chambers 22), there are few design restrictions relating to the size of the common liquid chamber 25 and it is possible to provide the common liquid chamber 25 of a relatively large size. Furthermore, since the independent supply ports 23 are provided on the diaphragm 26, in such a manner that the common liquid chamber 25 and the pressure chambers 22 are directly connected through the independent supply ports 23, then the ink supply flow paths for guiding the ink from the common liquid chamber 25 to the pressure chambers 22 are shortened, the liquid flow direction is aligned with the direction of gravity (the downward direction in FIG. 3), and hence ink supply properties (refilling properties) can be improved.

Moreover, by disposing the common liquid chamber 25 on the upper side of the diaphragm 26, it is possible to make the length of the nozzle flow channel 21*a* from each pressure chamber 22 to the nozzle 21 relatively short. Accordingly, even in the case of a composition where the pressure chambers 22 are disposed at a high density, it is possible to eject ink of high viscosity (of approximately 20 cP to 50 cP, for example), and furthermore, it is also possible to achieve a flow channel structure which permits swift refilling after ejection, and driving at high frequency becomes possible.

Moreover, since the electrical wires 30 erect in a column shape in a substantially perpendicular direction from the electrode pads 29 of the piezoelectric elements 28, in such a manner that the space of the common liquid chamber 25 is created by the column-shaped structure of the electrical wires 30, then it is possible to reduce the patterning surface area of the wires in comparison with a composition where the individual electrodes of the piezoelectric elements are patterned in a plane parallel to the piezoelectric element layer. Hence, the pressure chamber units 24 can be disposed at high density, and it is also possible to ensure the strength of the common liquid chamber 25 (the rigidity of the print head 10) by means of the column-shaped structure of the electrical wires 30.

There are no particular restrictions on the size of the respective sections of the print head 10, but to give one example, the pressure chamber 22 has a height of 150 μm and a square planar shape of 300 μm×300 μm, the thickness of the piezoelectric body 28*a* is 10 μm, the film thickness of the individual electrode 27 is 1 μm to 2 μm, the height of the electrical wires 30 is 500 μm, and the thickness of soft metallic sections 32 in the electrical wires 30 is approximately 50 μm to 100 μm.

The electrical wires 30 in the print head 10 according to the present embodiment have a two-layer structure in which metal sections of different hardness of combined. More specifically, the electrical wire 30 comprises a first metal section of relatively high hardness (hereinafter referred to as "hard metal section") 31, and a second metal section of lower hardness (hereinafter referred to as "soft metal section") 32. The hard metal section 31 has the hardness required in order to obtain the necessary strength in the column section forming the structural body. For example, the hard metal section 31 is made of a hard material, such as platinum (Pt), and desirably, the hard metal is deposited directly onto the electrode pad 29 by using a spray deposition method, such as the aerosol deposition method.

On the other hand, the soft metal section 32 is formed by fabricating a film of a material classified as a soft metal, by the aerosol deposition, in order to relieve the pressure occurring when the electrical wires 30 and the wiring substrate 34 are bonded (installed). In FIG. 3, an electrode pad 35 is formed on the wiring substrate 34, and conductive adhesive 36 containing an electrically conductive filler connects the electrode pad 35 with the soft metal section 32.

In the case of the structure shown in FIG. 3, the diaphragm 26 having the piezoelectric element 28 corresponds to the "first substrate", and the wiring substrate 34 having the electrode pad 35 corresponds to the "second substrate". Furthermore, the hard metal section 31 corresponds to the "first conducting member", and the soft metal section 32 corresponds to the "second conducting member".

The electrode pads 35 of the wiring substrate 34 may be formed by filling a conductive material, such as solder, into through holes 34A formed in the wiring substrate 34, or the electrode pads 35 may be formed by plating the through holes 34A.

The conductive adhesive 36 is, for example, an epoxy adhesive mixed with conductive granules, which are obtained by Ni—Au electroless plating on polystyrene spheres, for example. Apart from this, it is also possible to use an anisotropic conductive film (ACF). In either case, a bond is created in which the electrical connection is established in only the direction of pressurization, and insulation is provided in all other directions. For achieving bonding combined with electrical connection, it is possible to adopt a mode using solder, instead of the conductive adhesive or the anisotropic conductive film described above.

The material used in the soft metal section 32 may be, for example, gold (Au), silver (Ag), aluminum (Al), titanium (Ti), magnesium (Mg), copper (Cu), and the like.

Even if the same metal material is used, the hardness may differ with variations in the forming method or processing method (the film formation conditions, and the like). Typical examples are shown in the table in FIG. 4, for the purpose of reference. This table is based on data presented as "Hardness of plating metals and normal metals (II)" on the homepage of the Tokyo Electoplaters' Union (http://www.tmk.or.jp/). As shown in this table, generally, a metal formed by plating has greater hardness (Brinell hardness) than a normal metal formed by another method (annealing, drawing, forging). The hardness of a metal formed as a film by the aerosol deposition depends on the film formation conditions (the particle side of the starting powder material, the speed of the particles, and the like). In the case of the same starting powder material, the hardness is greater, the higher the speed of the particles.

Method of Manufacturing Print Head

Figure 5:
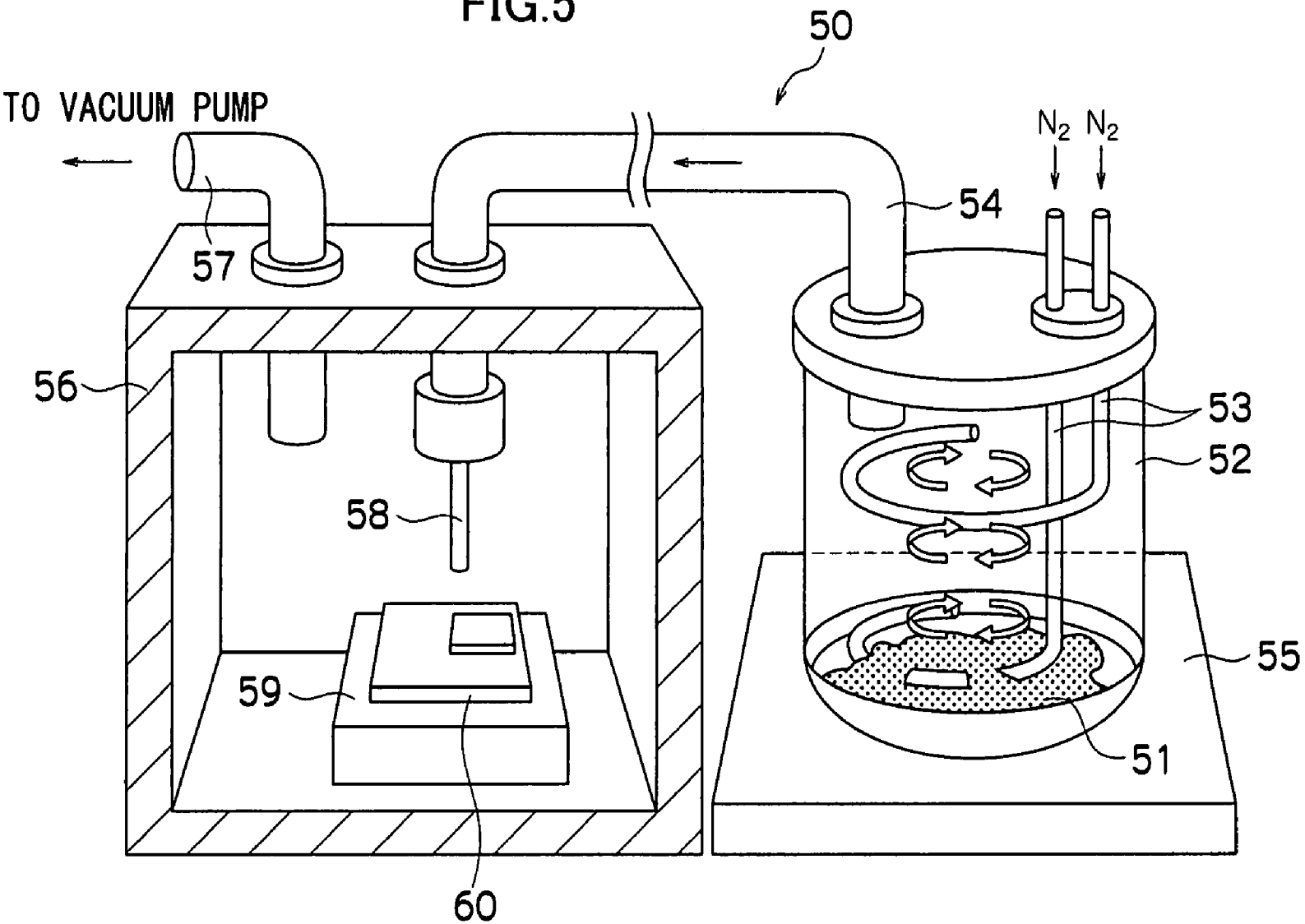
FIG. 5 is a schematic drawing showing the composition of a film formation device based on the aerosol deposition method.

Next, a method of manufacturing the print head 10 will be described. The column-shaped electrical wires 30 in the print head 10 having the structure described in FIGS. 1 to 3 are formed by the aerosol deposition, and a film formation method using the aerosol deposition will be described broadly. The aerosol deposition is a film formation method in which aerosol is generated from powder of raw material, the aerosol is sprayed onto a substrate, and a film is formed by deposition of the powdered material due to its impact energy. FIG. 5 is a schematic drawing showing a film formation device based on the aerosol deposition method. This film formation device 50 has an aerosol generating chamber 52, which accommodates raw material powder 51. Here, "aerosol" refers to fine particles of solid or liquid that are suspended in gas.

The aerosol generating chamber 52A is provided with carrier gas input sections 53, an aerosol output section 54, and a vibrating unit 55. The aerosol is generated by introducing a gas, such as nitrogen gas ($N_2$) through the carrier gas input sections 53 and thereby blowing and lifting the raw material powder that is accommodated in the aerosol generating chamber 52. In this case, by applying vibration to the aerosol generating chamber 52 by means of the vibrating unit 55, the raw material powder is churned up and the aerosol is generated efficiently. The aerosol thus created is conveyed through the aerosol output section 54 to a film formation chamber 56.

The film formation chamber 56 is provided with an evacuation tube 57, a spray nozzle 58 and a movable stage 59. The evacuation tube 57 is connected to a vacuum pump (not shown) to evacuate the interior of the film formation chamber 56. The aerosol generated in the aerosol generating chamber 52 and conveyed to the film formation chamber 56 through the aerosol output section 54 is sprayed from the spray nozzle 58 onto a substrate 60. Thereby, the raw material powder collides with and is deposited on the substrate 60. The substrate 60 is mounted on a movable stage 59, which is capable of three-dimensional movement, so that the relative positions of the substrate 60 and the spray nozzle 58 can be adjusted by controlling the movable stage 59.

Figure 6:
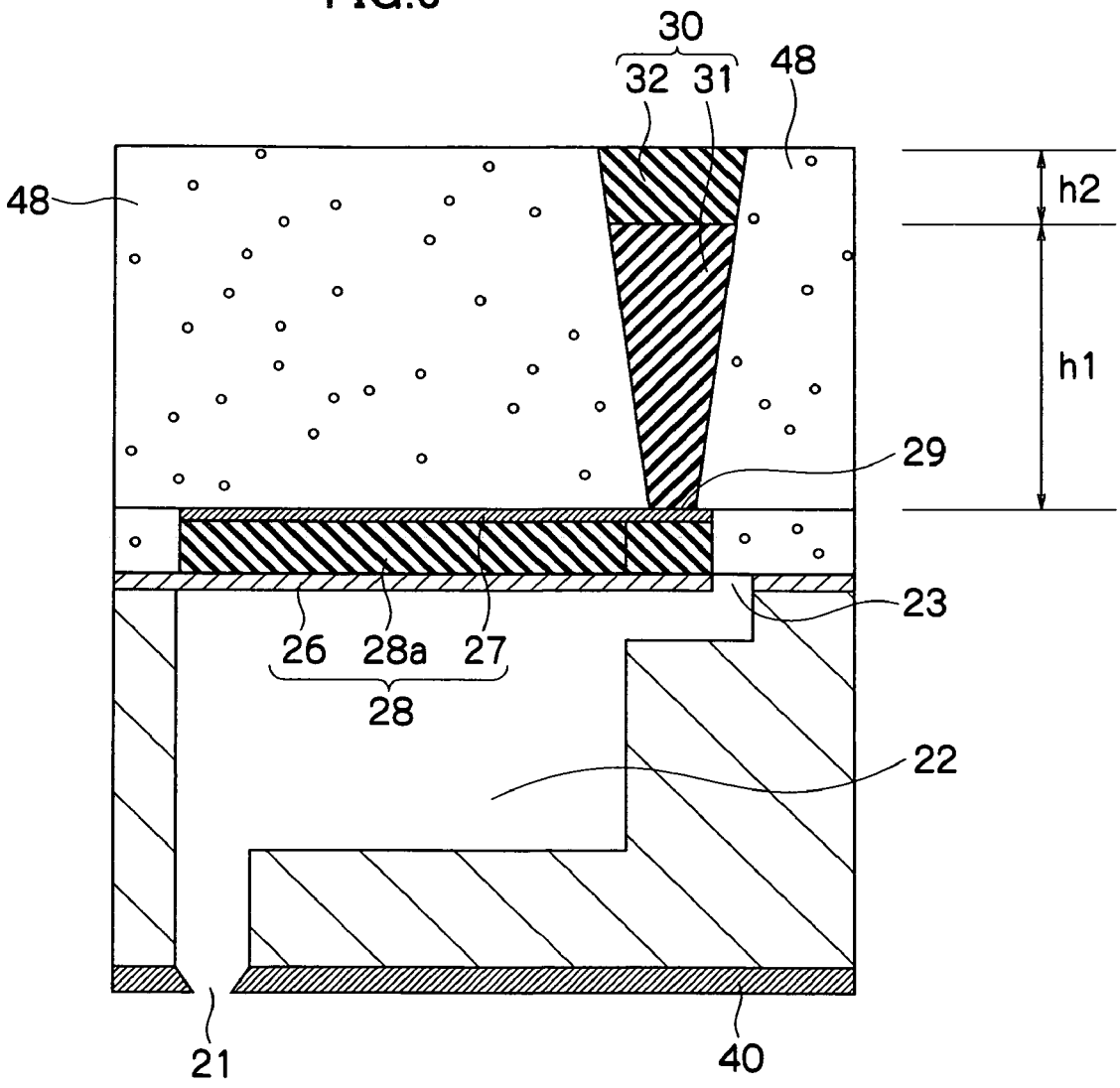
FIG. 6 is a schematic cross-sectional diagram showing an embodiment in which electrical wires are formed by the aerosol deposition method.

FIG. 6 is a schematic cross-sectional diagram showing an embodiment in which the electrical wires 30 are formed by the aerosol deposition as described above. In FIG. 6, the upper side surface of the piezoelectric elements 28, on which the electrical wires 30 are to be formed (the reverse side to the pressure chambers 22), is covered with resist 48 in the portions apart from the regions where the electrical wires 30 are to be formed (the regions of the piezoelectric elements 28 corresponding to the electrode pads 29). In this state, firstly, a film is formed by the aerosol deposition (which film is hereinafter referred to as an AD film) using the material of the hard metal section 31, thereby forming the hard metal sections 31 on the electrode pads 29. As the AD film formation process continues, the metallic material accumulates progressively in the height direction in FIG. 6.

When the hard metal sections 31 have been formed to a prescribed height h1, the film formation conditions of the aerosol deposition are changed and the soft metal sections 32 are formed. It is possible to form the soft metal sections 32 by changing the material of the starting powder used for film formation, or by using the same material as the hard metal sections 31 by changing the speed of the particles. When the soft metal sections 32 have been formed to a prescribed height h2 (where h2<h1), then film formation is stopped.

Figure 7A:
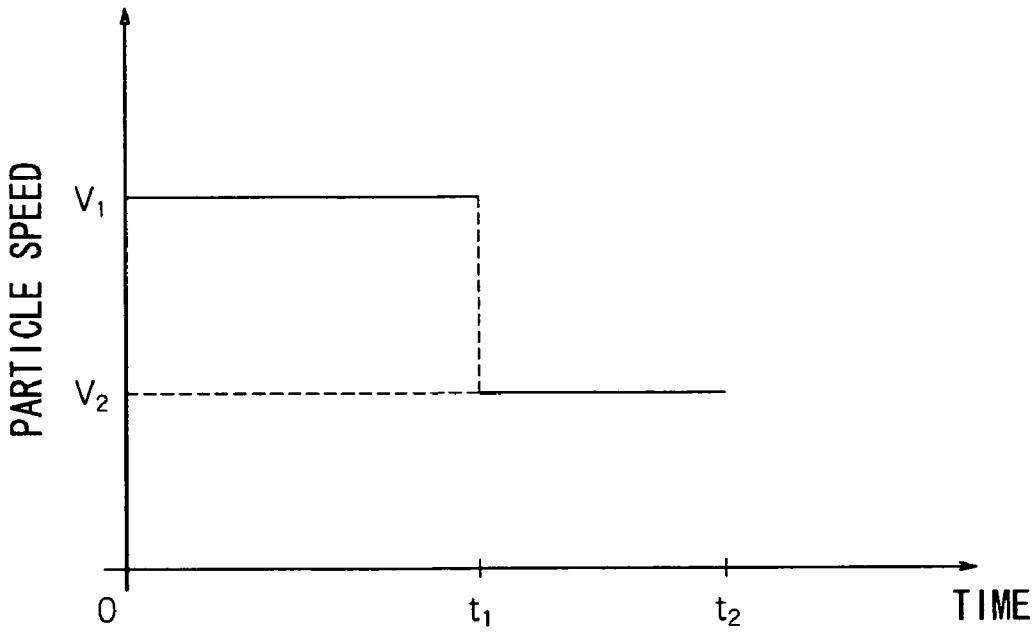
FIGS. 7A and 7B are graphs showing examples of the relationship between film formation time and particle speed, when a hard metal section and a soft metal section are formed by changing the film formation conditions in the aerosol deposition method.

FIG. 7A is a graph showing an embodiment of the control of the particle speed in a case where the hard metal sections 31 and the soft metal sections 32 are formed by controlling the particle speed during the AD film formation using the same material. The horizontal axis indicates time and the vertical axis indicates the speed of the particles. As shown in FIG. 7A, film formation is carried out at a particle speed of V1 from the film formation start time t=0 until time t1, thereby forming the hard metal sections 31. Thereupon, the particle speed is reduced to a particle speed V2 (where V2<V1). Film formation is carried out until time t2 at this particle speed V2, thereby forming the soft metal sections 32.

Figure 7B:
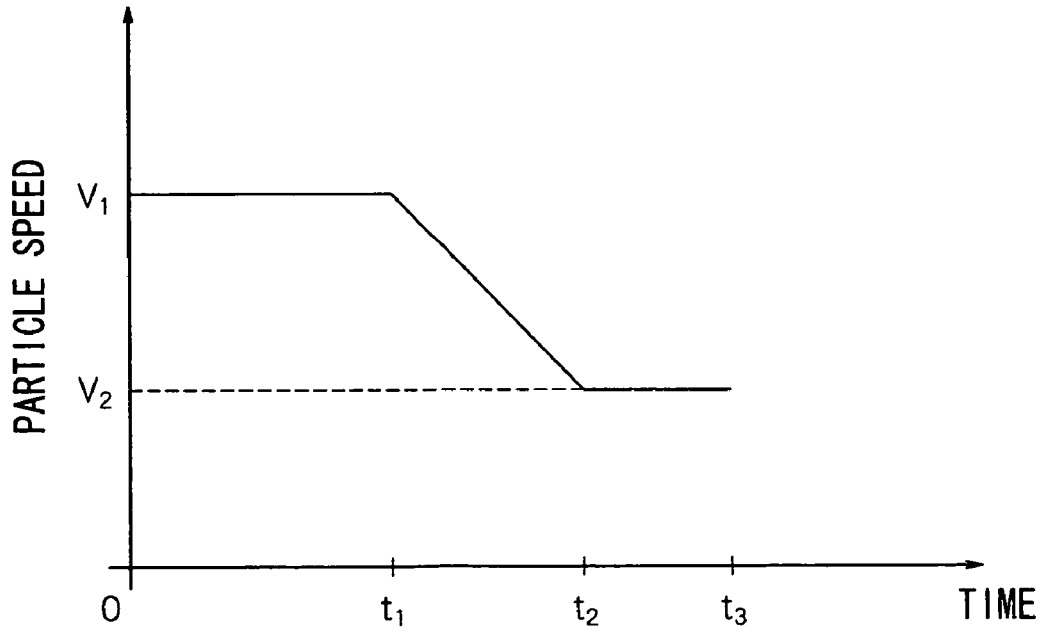

Instead of the embodiment shown in FIG. 7A, it is also possible to use an embodiment of the control shown in FIG. 7B. As shown in FIG. 7B, film formation is carried out at the particle speed of V1 from the film formation start time t=0 until time t1, thereby forming the hard metal sections 31. Thereupon, the speed is gradually lowered until time t2, where it reaches the particle speed V2. Film formation is carried out until time t3 at this particle speed V2, thereby forming the soft metal sections 32.

The third metal section (hereinafter referred to as an "intermediate metal section") of which hardness changes continuously is formed in the intermediate section between the hard metal section 31 and the soft metal section 32, by the film formation in the time period from time t1 until t2. Therefore, in strict terms, the three-layer structure is formed. However, the intermediate metal section can be interpreted as being one portion of the hard metal section 31, or it can be interpreted as being one portion of the soft metal section 32, and whichever of these interpretations is adopted, it presents no technical contradictions in the present invention. Alternatively, a hardness reference value that divides the soft section and the hard section can be established in the intermediate metal section, and the region having the hardness exceeding this reference value can be treated as the soft metal section 31, while the region having the hardness lower than the reference value can be treated as the soft metal section 32.

Figure 8:
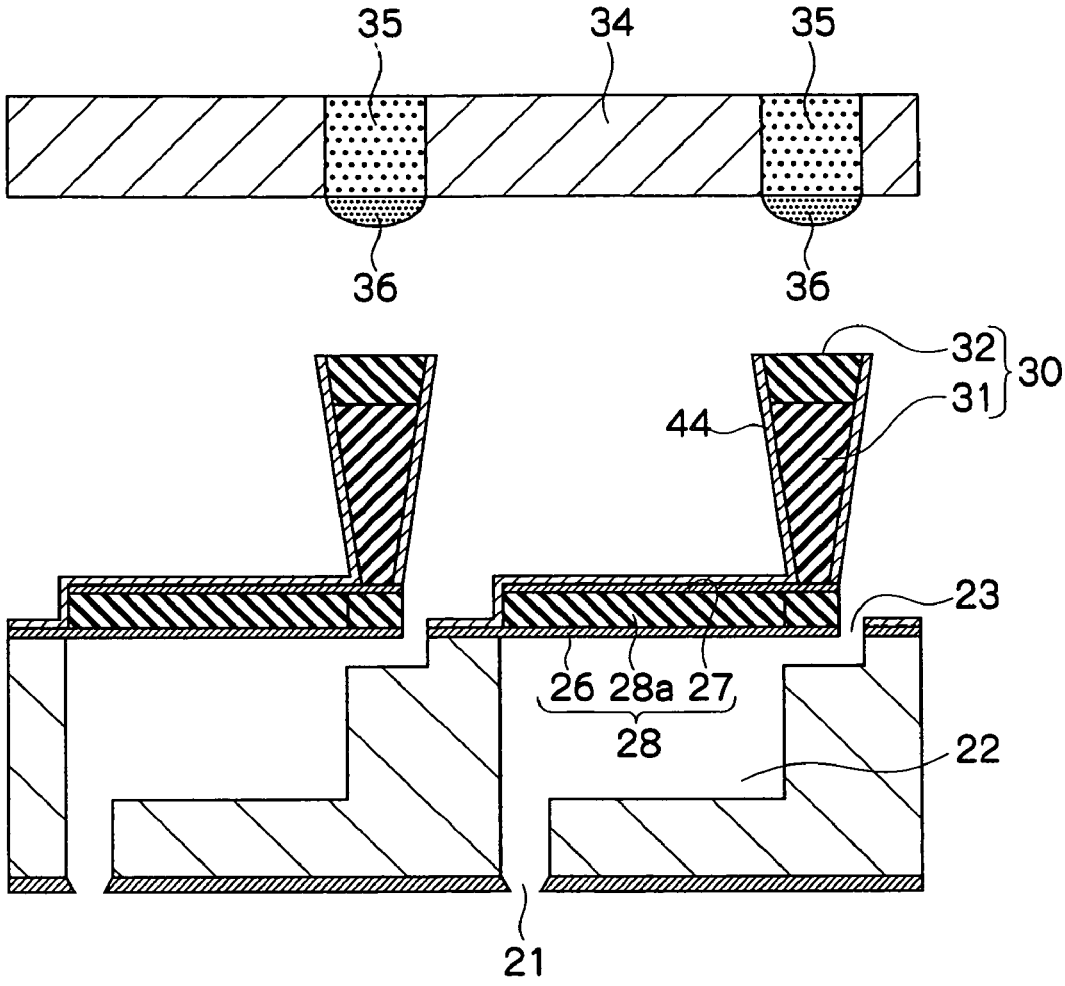
FIG. 8 is a diagram for explaining a step of bonding together electrical wires and a wiring substrate.

The electrical wires 30 having the hard metal sections 31 and the soft metal sections 32 are thus formed as shown in FIG. 6, the resist 48 is then removed, and the surfaces which make contact with the ink (liquid-contacting surfaces) are coated with the insulating protective film 44 as shown in FIG. 8. Desirable coating materials are: polyimide (PI), parylene, urethane, or the like.

Figure 9:
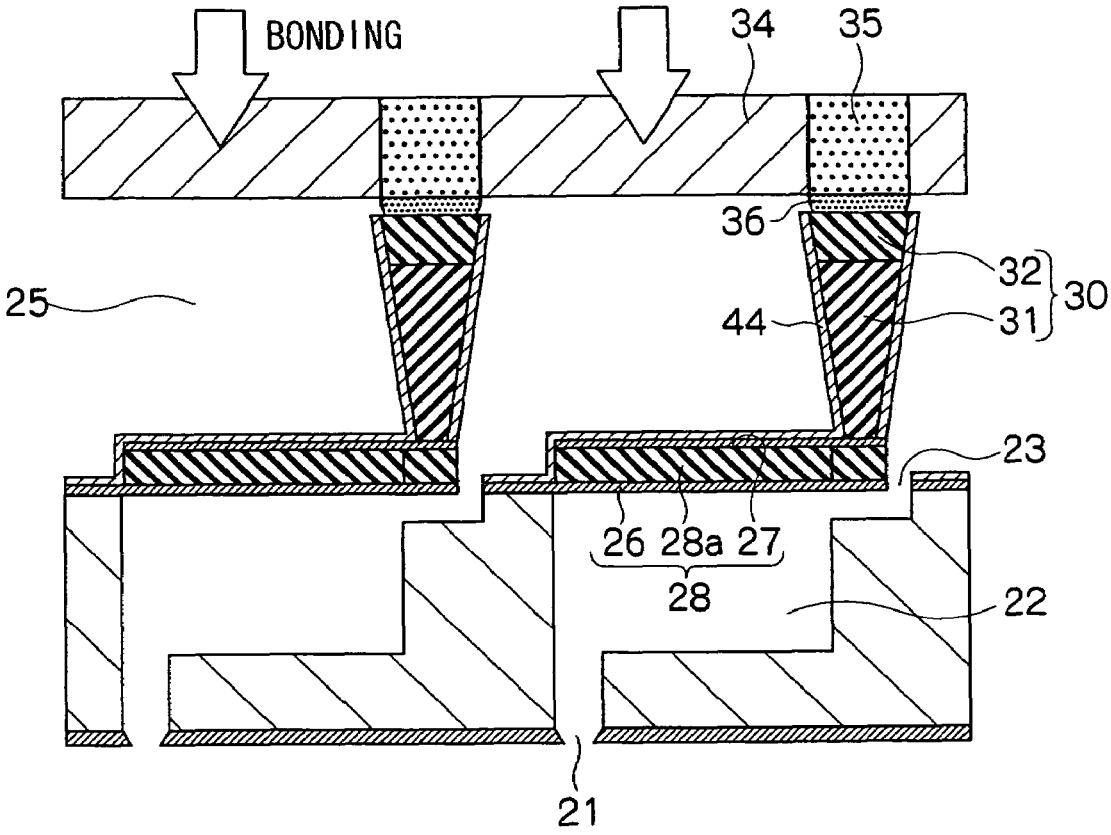
FIG. 9 is a diagram for explaining the step of bonding together the electrical wires and the wiring substrate.

Thereupon, as shown in FIG. 9, the electrode pads 35 of the wiring substrate 34 and the upper end sections of the electrical wires 30 (the upper end sections of the soft metal sections 32) are aligned with each other, and the electrode pads 35 of the wiring substrate 34 are bonded with the electrical wires 30 through the conductive adhesive 36. When pressure is applied during bonding, since the installation part of each electrical wire 30 connected to the wiring substrate 34 is made of the soft metal section 32, which absorbs the installation pressure, and hence excessive pressure is not applied to the layer of the piezoelectric body 28*a*. Furthermore, a bonding operation is not required to provide a connection between the electrical wire 30 and the electrode pad 29 on the piezoelectric element 28. Therefore, the external pressure applied to the piezoelectric body 28*a* during assembly is reduced, and the connection reliability in the connection section can be raised. The electrical connections are thereby established between the piezoelectric elements 28 and the electrode pads 35 of the wiring substrate 34 through the electrical wires 30, respectively, and the piezoelectric elements 28 are thus enabled to be driven by the drive signals applied through the electrical wires 30.

After the bonding step shown in FIG. 9, the liquid-contacting surface of the wiring substrate 34 (the surface on the side adjacent to the common liquid chamber 25) is coated with the insulating protective film 44.

There are no particular restrictions of the method for forming the piezoelectric elements 28, it is preferable to form the piezoelectric bodies 28*a* and the electrode layer (the individual electrodes 27 and the electrode pads 29) by the aerosol deposition, so that an integrated process using the same film formation chamber as for forming the electrical wires 30 becomes possible, and hence the manufacturing steps can be simplified and costs can be reduced.

In the present embodiment, the diaphragm 26 also serves as the common electrode; however, in implementing the present invention, it is also possible to adopt a composition in which the diaphragm is made of a material such as ceramic or resin, and an electrode layer (conducting film) is formed on top of the diaphragm.

Method for Manufacturing Print Head (Modification 1)

In the foregoing description, the electrical wires 30 are formed by the aerosol deposition onto the electrode pads 29 on the piezoelectric elements 28, and the soft metal sections 32 are formed in the portions corresponding to the installation regions with the electrode pads 35 of the wiring substrate 34 (the upper parts of the electrical wires 30 in FIG. 8); however, the implementation of the present invention is not limited to the aforementioned embodiment. For example, it is also possible to adopt a mode in which electrical wires are formed by the aerosol deposition onto the surface of the electrode pads 35 of the side of the wiring substrate 34, and soft metal sections are formed in the portions corresponding to the installation regions with the electrode pads 29 in the piezoelectric elements 28.

Figure 10:
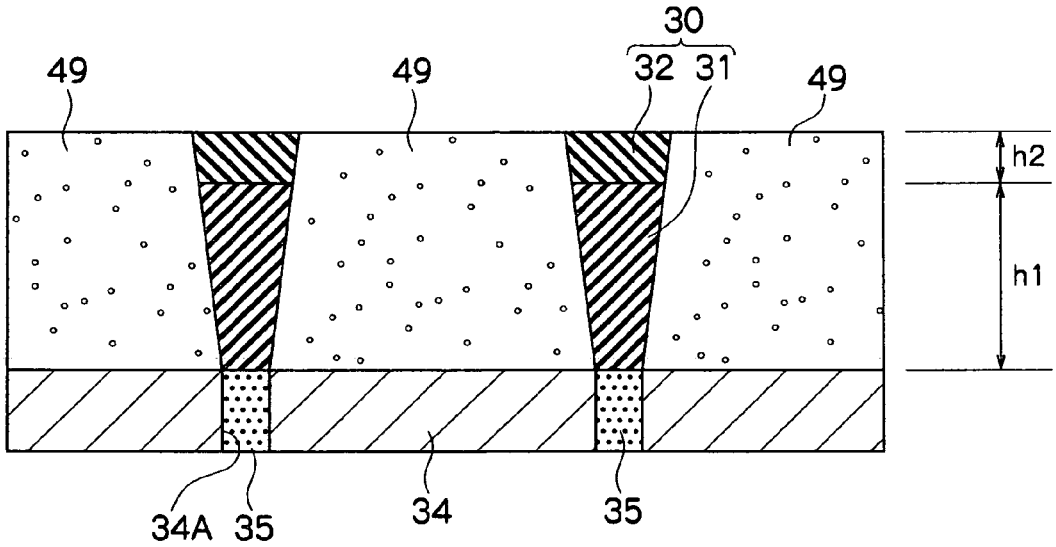
FIG. 10 is a schematic cross-sectional diagram showing an embodiment in which electrical wires are formed on a wiring substrate.

In this case, for example, as shown in FIG. 10, the surface of the wiring substrate 34 on the side adjacent to the common liquid chamber 25 (the upper surface in FIG. 10) is covered with resist 49, except for the regions where the electrical wires 30 are to be formed (the portions corresponding to the electrode pads 35). In this state, firstly, a film is manufactured by the aerosol deposition using the material of the hard metal sections 31, thereby forming the hard metal sections 31 on the electrode pads 35. As the AD film formation process continues, the metallic material accumulates progressively in the height direction in FIG. 10.

When the hard metal sections 31 have been formed to a prescribed height h1, the film formation conditions of the aerosol deposition method are changed and the soft metal sections 32 are formed. It is possible to form the soft metal sections 32 by changing the material of the starting powder used for film formation, or by using the same material as the hard metal sections 31 by changing the speed of the particles. When the soft metal sections 32 have been formed to a prescribed height h2 (where h2<h1), then film formation is stopped.

The electrical wires 30 having the hard metal sections 31 and the soft metal sections 32 are thus formed, and the resist 49 is then removed. After removing the resist 49, although omitted from the drawing, the surfaces that make contact with the ink (liquid-contacting surfaces) are coated with the insulating protective film 44, the end faces of the soft metal sections 32 are aligned in position with the electrode pads 29 on the piezoelectric elements, and they are bonded together by applied pressure (external force) in the direction of lamination.

In this mode, the wiring substrate 34 corresponds to the "first substrate", and the diaphragm provided with the piezoelectric elements corresponds to the "second substrate".

In the further modification of the embodiment shown in FIG. 10, a portion of each of the electrode pads 35 of the wiring substrate 34 can be formed integrally with the hard metal section 31 by means of the AD film formation. In this case, for example, a dummy substrate (not shown) forming a film formation surface for the AD film forming is disposed on the lower surface of the wiring substrate 34 in which the through holes 34A have been formed, and after forming column-shaped electrical wires through the through holes 34A by performing the aerosol deposition on the dummy substrate, the dummy substrate is peeled away from (separated from) the wiring substrate 34.

Method for Manufacturing Print Head (Modification 2)

Figure 11:
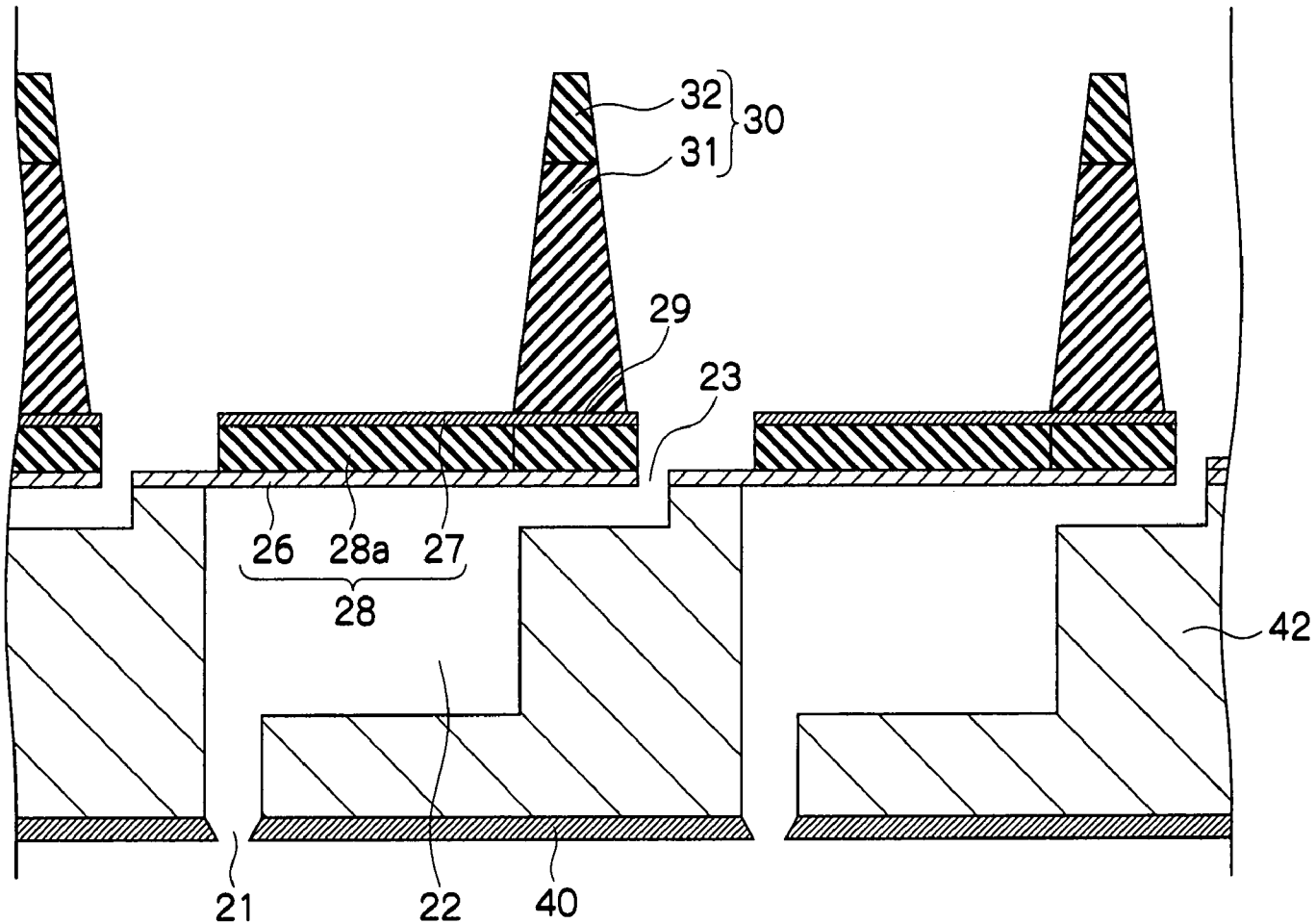
FIG. 11 is a cross-sectional diagram for explaining a further method of forming column-shaped electrical wires.

In FIG. 6, the electrical wires 30 are formed by the AD film formation using the resist 48; however, a method which does not use the resist 48 is also possible. Particles can be made to accumulate selectively at desired positions on the substrate 60, by moving the spray nozzle 58 of the film formation device 50 described in FIG. 5. By using a moving type spray nozzle 58 of this kind, it is possible to form the hard metal sections 31 directly on the electrode pads 29 of the piezoelectric elements 28, as shown in FIG. 11. In FIG. 11, members which are the same as or similar to the composition shown in FIG. 6 are denoted with the same reference numerals and description thereof is omitted here.

Figure 12:
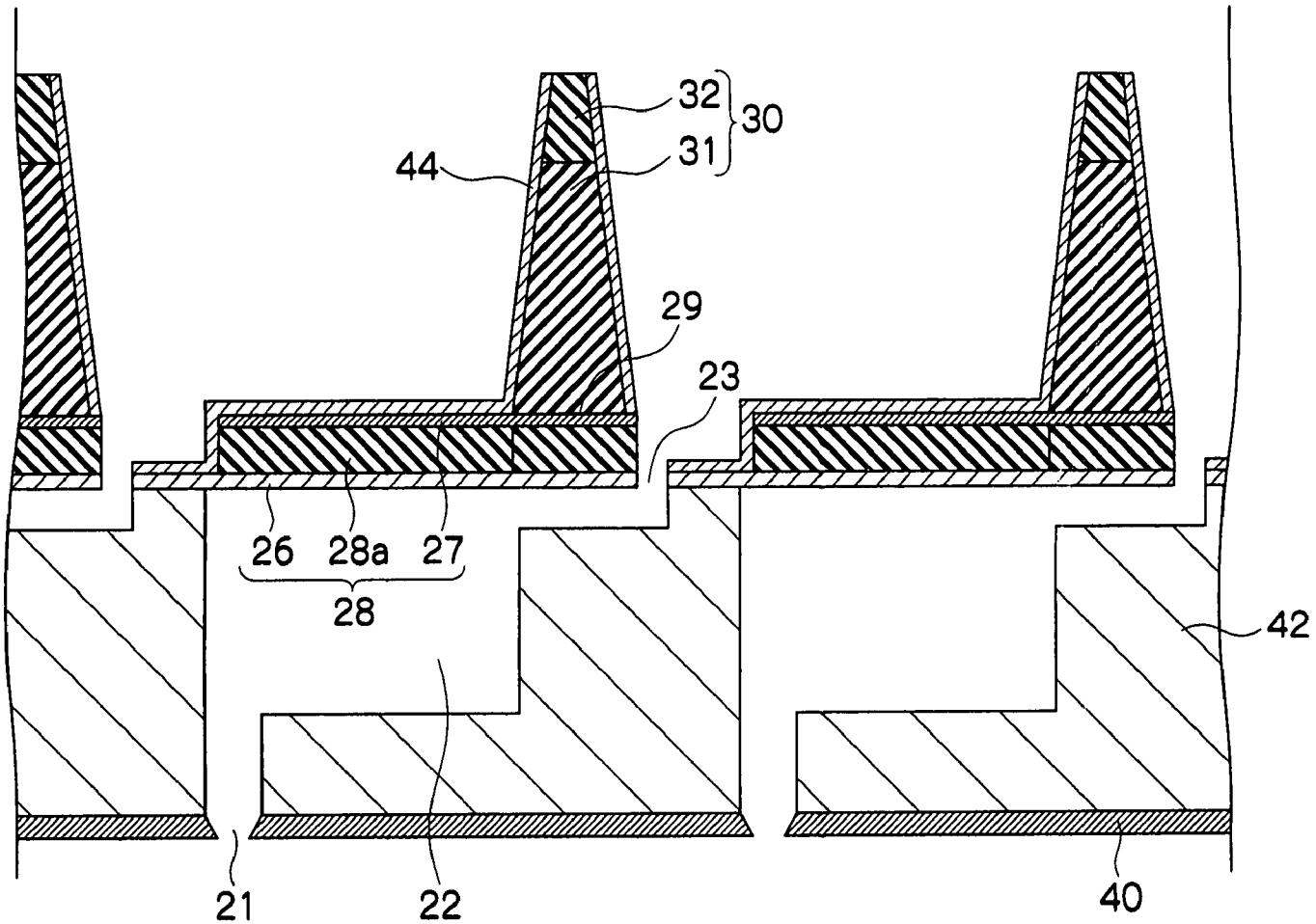
FIG. 12 is a cross-sectional diagram showing an embodiment of forming an insulating protective film on liquid-contacting surfaces, in the composition shown in FIG. 11.

After forming the column-shaped electrical wires 30 in FIG. 11, the insulating protective film 44 is applied by vapor deposition, as shown in FIG. 12. Although not shown in the drawings, the subsequent manufacturing steps involve aligning the electrode pads 35 of the wiring substrate 34 with the upper end sections of the electrical wires 30 (the upper end sections of the soft metal sections 32), and then bonding same together by applying pressure (external force) in the direction of superimposition, similarly to the embodiment described in FIGS. 8 and 9.

Method for Manufacturing Print Head (Modification 3)

Figure 13:
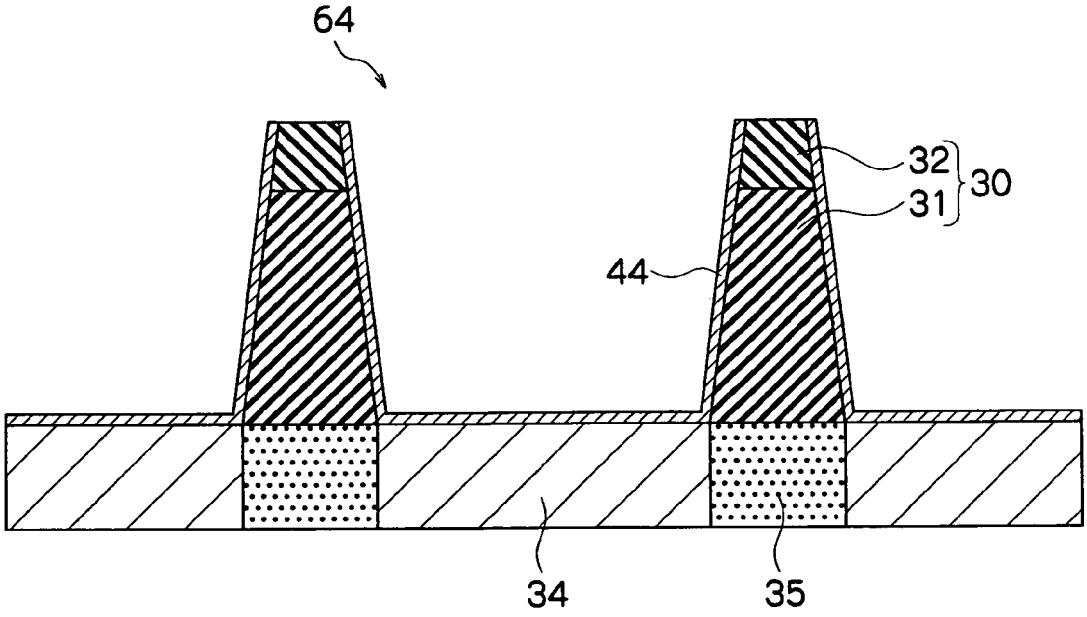
FIG. 13 is a cross-sectional diagram for explaining a further method of forming electrical wires on a wiring substrate.

In the embodiment described with reference to FIG. 10, the column-shaped electrical wires 30 are formed on the wiring substrate 34 by the AD film formation using the resist 49; however, similarly to the embodiment described with reference to FIG. 11, it is possible to form the electrical wires 30 directly on the electrode pads 35 of the wiring substrate 34 as shown in FIG. 13 without using the resist 49, by moving the spray nozzle 58 of the film formation device 50. The insulating protective film 44 is applied by vapor deposition onto the peripheral region of the electrical wires 30 (the surfaces which make contact with the ink).

Figure 14:
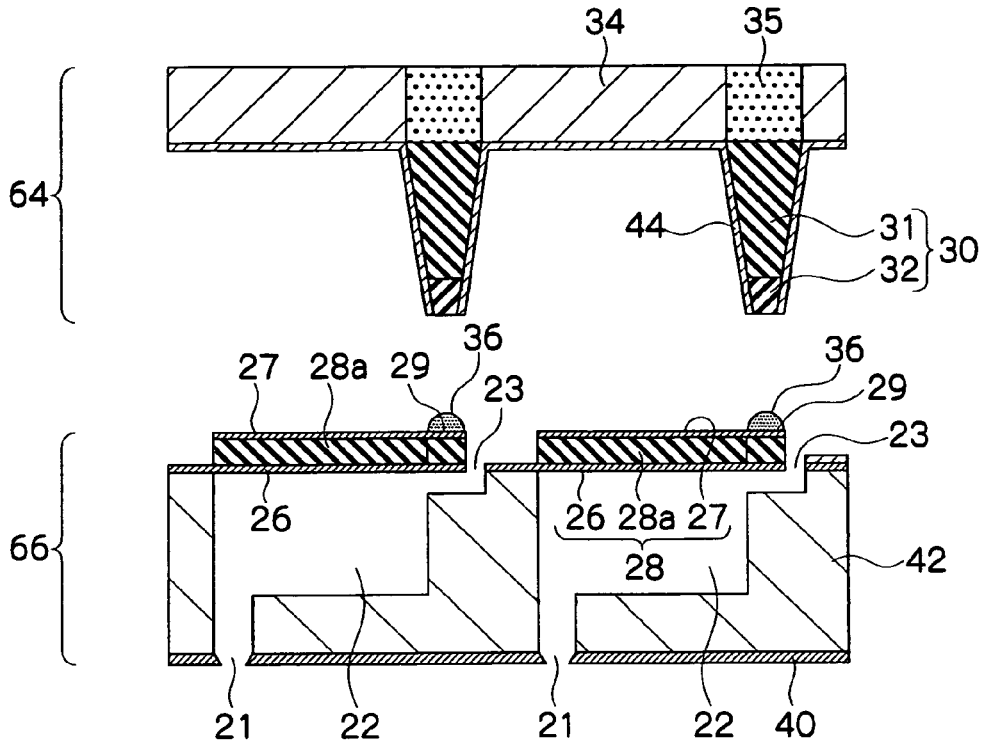
FIG. 14 is a diagram for explaining a step of bonding the structural part shown in FIG. 13 with the structural part on the pressure chamber side.
Figure 15:
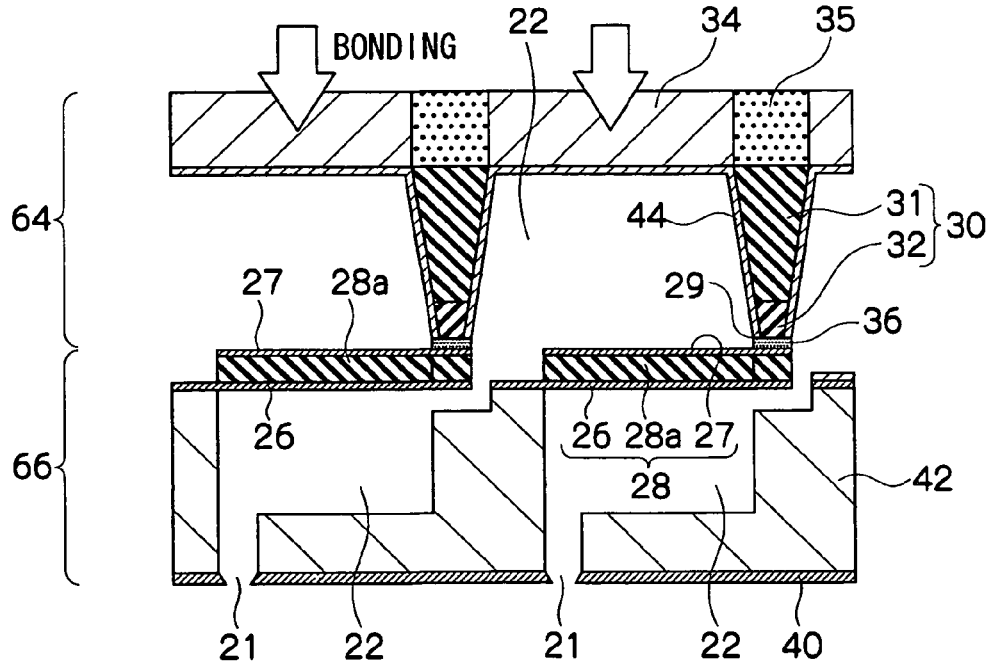
FIG. 15 is a diagram for explaining the step of bonding the structural part shown in FIG. 13 with the structural part on the pressure chamber side.

As shown in FIG. 14, the wiring substrate 34 to which electrical wires 30 have been formed as shown in FIG. 13 (indicated as an upper head structural part 64 in FIG. 14) is placed opposing a lower head structural part 66, with the side of the electrical wires 30 facing the surface of the piezoelectric elements 28, and the lower end sections of the electrical wires 30 (the end surfaces of the soft metal parts 32) are aligned in position with the electrode pads 29 of the piezoelectric elements 28, whereupon the electrical wires 30 and the electrode pads 29 are bonded through the conductive adhesive 36 as shown in FIG. 15. The electrical connections are thereby established between the piezoelectric elements 28 and the electrode pads 35 of the wiring substrate 34 through the electrical wires 30, respectively, and the piezoelectric elements 28 are thus enabled to be driven by the drive signals applied through the electrical wires 30. In FIGS. 14 and 15, items which are the same as or similar to those in FIGS. 8 and 9 are denoted with the same reference numerals and description thereof is omitted here.

In the mode shown in FIGS. 13 to 15, the wiring substrate 34 corresponds to the "first substrate", and the diaphragm 26 provided with the piezoelectric elements 28 corresponds to the "second substrate".

Method for Manufacturing Print Head (Modification 4)

In the methods of manufacture described above, the surfaces (liquid-contacting surfaces) are coated with the insulating protective film 44 after forming the column-shaped electrical wires 30; however, the implementation of the present invention is not limited to this mode. For example, it is also possible to adopt a mode in which tubular insulating members (hollow insulating members) corresponding to the protective film 44 are formed previously from an insulating material, such as resin, and the electrical wires 30 corresponding to the column sections are accumulated inside these insulating members by the aerosol deposition.

Further Embodiment of Structure of the Print Head

In the embodiment described with reference to FIG. 3, the column-shaped electrical wires 30 rise upward from the electrode pads 29 in the same plane as the individual electrodes 27 of the piezoelectric elements 28 (i.e., from the electrode pads 29 formed on the upper surface of the layer of the piezoelectric bodies 28*a*); however, the implementation of the present invention is not necessarily limited to a mode where the electrical wires 30 are formed on top of the piezoelectric elements 28.

Figure 16:
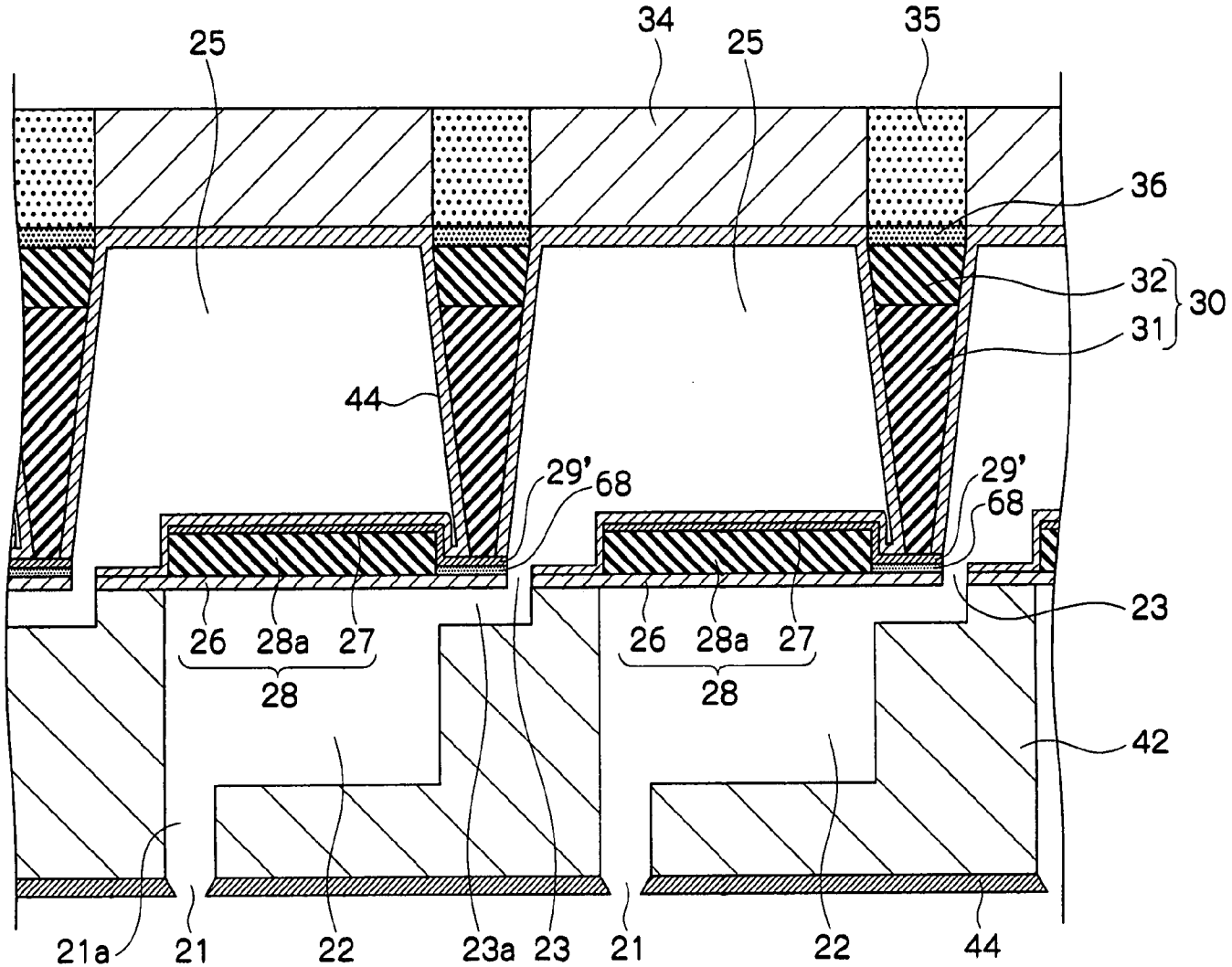
FIG. 16 is a cross-sectional diagram showing a further embodiment of the composition of a print head.

For example, as shown in FIG. 16, it is also possible to adopt a composition in which an electrode extends from the end section of the individual electrode 27 formed on the upper surface of the piezoelectric body 28*a* and is bent in a step fashion in the thickness direction of the piezoelectric body 28*a*, thereby forming an electrode pad 29' at a plane lower than the surface of the individual electrode 27, and the column-shaped electrical wire 30 is erected from this electrode pad 29'. In this case, an insulating film (insulating layer) 68 made of an insulating material is provided between the electrode pad 29' and the diaphragm 26, which also serves as the common electrode. In this composition, it is possible to reduce damage to the diaphragm 26 caused by the application of external force during bonding. In FIG. 16, items which are the same as or similar to those in FIG. 3 are denoted with the same reference numerals and description thereof is omitted here.

General Composition of Inkjet Recording Apparatus

Next, an embodiment of an inkjet recording apparatus using the print head 10 described above will be explained.

Figure 17:
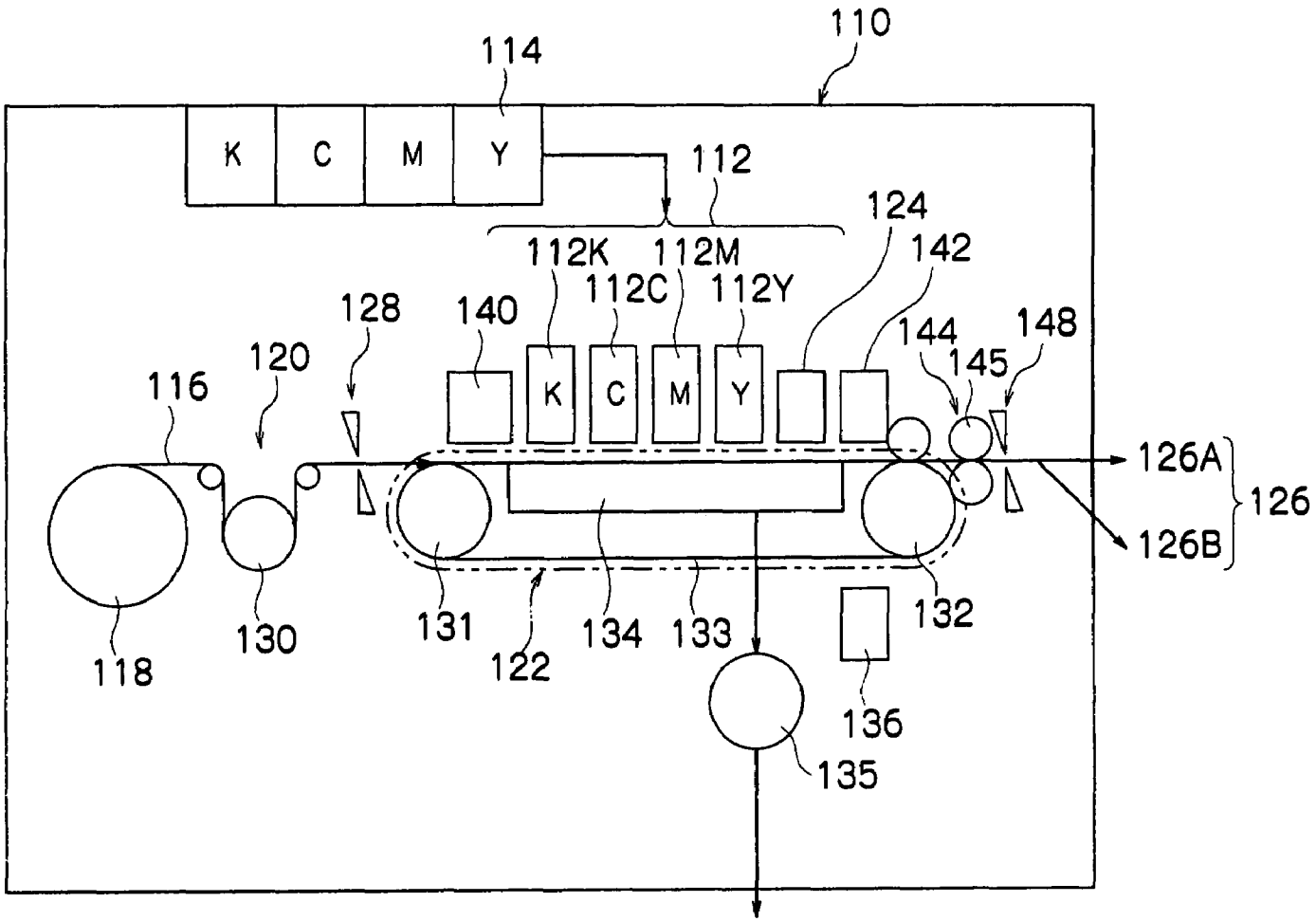
FIG. 17 is a general compositional diagram showing an inkjet recording apparatus as an embodiment of the image forming apparatus according to the present invention.

FIG. 17 is a general configuration diagram of an inkjet recording apparatus 110 as an embodiment of an image forming apparatus according to the present invention. As shown in FIG. 17, the inkjet recording apparatus 110 comprises: a printing unit 112 having a plurality of inkjet recording heads (hereafter referred to as simply "heads") 112K, 112C, 112M, and 112Y provided for ink colors of black (K), cyan (C), magenta (M), and yellow (Y), respectively; an ink storing and loading unit 114 for storing inks of K, C, M and Y to be supplied to the print heads 112K, 112C, 112M, and 112Y; a paper supply unit 118 for supplying recording paper 116 which is a recording medium; a decurling unit 120 removing curl in the recording paper 116; a belt conveyance unit 122 disposed facing the nozzle face (ink-droplet ejection face) of the printing unit 112, for conveying the recording paper 116 while keeping the recording paper 116 flat; a print determination unit 124 for reading the printed result produced by the printing unit 112; and a paper output unit 126 for outputting image-printed recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 17, a magazine for rolled paper (continuous paper) is shown as an example of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium can be used, it is preferable that an information recording medium such as a bar code and a wireless tag containing information about the type of medium is attached to the magazine, and by reading the information contained in the information recording medium with a predetermined reading device, the type of recording medium to be used is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 17, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the printing unit 112 on the interior side of the belt 133, which is set around the rollers 131 and 132, as shown in FIG. 17. The suction chamber 134 provides suction with a fan 135 to generate a negative pressure, and the recording paper 116 is held on the belt 133 by suction. It is also possible to use an electrostatic attraction method, instead of an electrostatic attraction method.

The belt 133 is driven in the clockwise direction in FIG. 17 by the motive force of a motor 188 (shown in FIG. 20) being transmitted to at least one of the rollers 131 and 132, which the belt 133 is set around, and the recording paper 116 held on the belt 133 is conveyed from left to right in FIG. 17.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, embodiments thereof include a configuration in which the belt 133 is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different than that of the belt 133 to improve the cleaning effect.

The inkjet recording apparatus 110 can comprise a roller nip conveyance mechanism, in which the recording paper 116 is pinched and conveyed with nip rollers, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the printing unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 18:
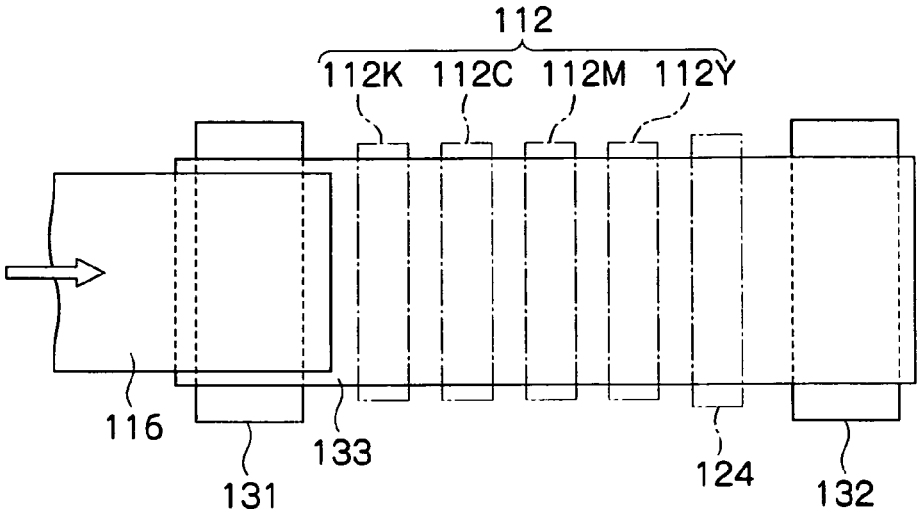
FIG. 18 is a principal plan diagram of the peripheral area of a print unit in the inkjet recording apparatus shown in FIG. 17.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 18).

The structure of the heads 112K, 112C, 112M and 112Y is the same as the structure of the print head 10 described with reference to FIGS. 1 to 16, and hence description thereof is omitted here.

As shown in FIG. 17, the print heads 112K, 112C, 112M and 112Y are arranged in color order (black (K), cyan (C), magenta (M), yellow (Y)) from the upstream side in the feed direction of the recording paper 116, and these heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the suction belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 shown in FIG. 17 has an image sensor (line sensor or area sensor) for capturing an image of the droplet ejection result of the print unit 112, and functions as a device to check for ejection defects such as blockages, deposition position displacement, and the like, of the nozzles from the image of ejected droplets read in by the image sensor. A test pattern or the target image printed by the print heads 112K, 112C, 112M, and 112Y of the respective colors is read in by the print determination unit 124, and the ejection performed by each head is determined. The ejection determination includes the presence of the ejection, measurement of the dot size, and measurement of the dot deposition position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 17, the paper output unit 126A for the target prints is provided with a sorter for collecting prints according to print orders.

Figure 19:
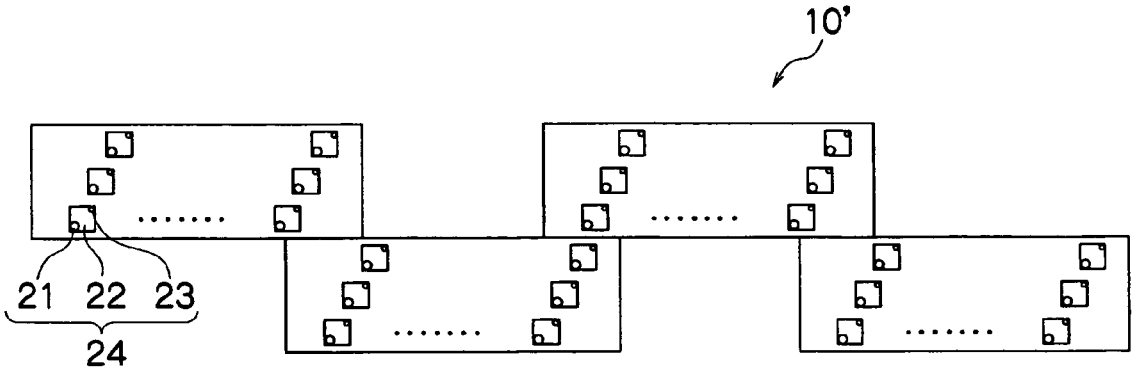
FIG. 19 is a plan diagram showing a further embodiment of the composition of a full line print head.

The mode of forming one or more nozzle rows through a length corresponding to the entire width of the recording paper 116 in a direction substantially orthogonal to the conveyance direction of the recording paper 116 is not limited to the embodiment shown in FIG. 1. For example, instead of a single long head structure, a line head having nozzle rows of a length corresponding to the entire length of the recording paper 116 can be formed by arranging and combining, in a staggered matrix, short head modules 10' having a plurality of nozzles 21 arrayed in a two-dimensional fashion, as shown in FIG. 19.

Furthermore, in implementing the present invention, the arrangement of the nozzles is not limited to that of the embodiment illustrated. Moreover, a method is employed in the present embodiment where an ink droplet is ejected by means of the deformation of the piezoelectric element 28; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 20:
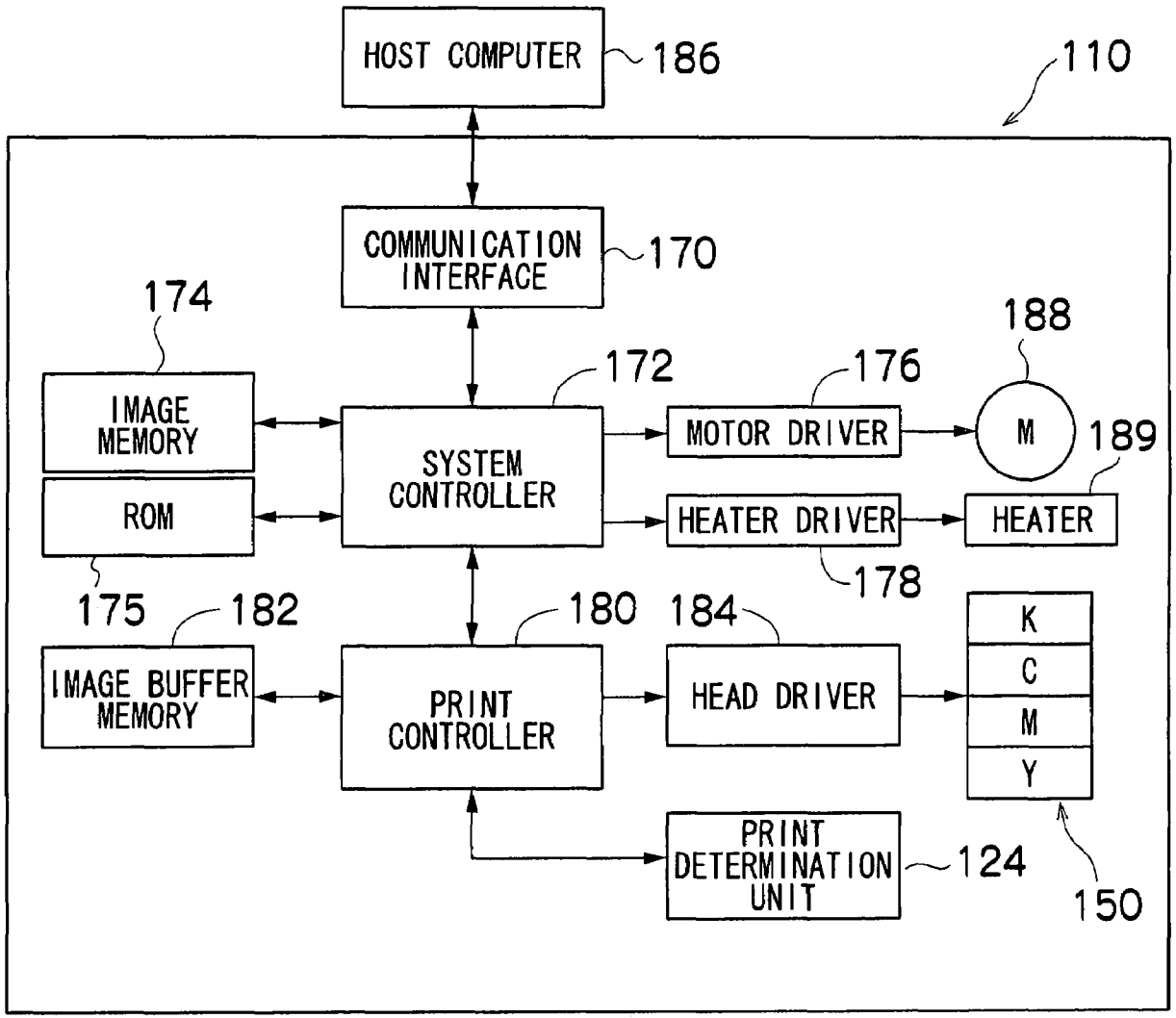
FIG. 20 is a principal block diagram showing the system composition of the inkjet recording apparatus.

FIG. 20 is a block diagram showing the system composition of the inkjet recording apparatus 110. As shown in FIG. 20, the inkjet recording apparatus 110 comprises a communication interface 170, a system controller 172, an image memory 174, a ROM 175, a motor driver 176, a heater driver 178, a print controller 180, an image buffer memory 182, a head driver 184, and the like. In order to simplify the drawing, the print heads of the respective colors are represented by one block 150.

The communication interface 170 is an interface unit for receiving image data sent from a host computer 186. A serial interface such as USB, IEEE1394, Ethernet, wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 110 through the communication interface 170, and is temporarily stored in the image memory 174. The image memory 174 is a storage device for temporarily storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, and the like, as well as controlling communications with the host computer 186 and writing and reading to and from the image memory 174 and ROM 175, and it also generates control signals for controlling the motor 188 and heater 189 of the conveyance system.

The program executed by the CPU of the system controller 172 and the various types of data which are required for control procedures are stored in the ROM 175. The ROM 175 may be a non-writeable storage device, or it may be a rewriteable storage device, such as an EEPROM. The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 of the post-drying unit 142 or the like in accordance with commands from the system controller 172.

The print controller 180 has a signal processing function for performing various tasks, compensations, and other types of processing for generating print control signals from the image data (original image date) stored in the image memory 174 in accordance with commands from the system controller 172 so as to supply the generated print data (dot data) to the head driver 184.

The image buffer memory 182 is provided in the print controller, and image data, parameters, and other data are temporarily stored in the image buffer memory 182 when image data is processed in the print controller 180. FIG. 20 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed (original image data) is inputted from an external source via the communications interface 170, and is accumulated in the image memory 174. At this stage, RGB image data is stored in the image memory 174, for example.

In the inkjet recording apparatus 110, an image which appears to have a continuous tonal graduation to the human eye is formed by changing the dot deposition density and the dot size of fine dots created by ink (coloring material), and therefore, it is necessary to convert the input digital image into a dot pattern which reproduces the tonal graduations of the image (namely, the light and shade toning of the image) as faithfully as possible. The original image data (RGB data) stored in the image memory 174 is sent to the print controller 180 through the system controller 172, and is converted to the dot data for each ink color by a half-toning technique, using dithering, error diffusion, or the like, in the print controller 180.

More specifically, the print controller 180 performs processing for converting the input RGB image data into dot data for the four colors of K, C, M and Y. Threshold value matrices are incorporated into the print controller 180, and are used when converting the original image into dot data. In this way, the dot data generated by the print controller 180 is stored in the image buffer memory 182.

The head driver 184 outputs drive signals for driving the piezoelectric elements 28 corresponding to the nozzles 21 of the print head 150, on the basis of the print data supplied by the print controller 180 (in other words, the dot data stored in the image buffer memory 182). A feedback control system for maintaining constant drive conditions in the head may be included in the head driver 184.

By supplying the drive signals outputted by the head driver 184 to the print head 150, ink is ejected from the corresponding nozzles 21. By controlling ink ejection from the print head 150 in synchronization with the conveyance speed of the recording paper 116, an image is formed on the recording paper 116.

As described above, the ejection volume and the ejection timing of the ink droplets from the nozzles are controlled via the head driver 184, on the basis of the dot data generated by implementing prescribed signal processing in the print controller 180. By this means, prescribed dot size and dot positions can be achieved.

As described with reference to FIG. 17, the print determination unit 124 is a block including an image sensor, which reads in the image printed on the recording medium 116, performs various signal processing operations, and the like, and determines the print situation (presence/absence of ejection, variation in droplet ejection, optical density, and the like), these determination results being supplied to the print controller 180. Instead of or in conjunction with this print determination unit 124, it is also possible to provide another ejection determination device (corresponding to an ejection abnormality determination device).

As a further ejection determination device, it is possible to adopt, for example, a mode (internal determination method) in which a pressure sensor is provided inside or in the vicinity of each pressure chamber 22 of the print head 150, and ejection abnormalities are determined from the determination signals obtained from these pressure sensors when ink is ejected or when the piezoelectric elements are driven in order to measure the pressure. Alternatively, it is also possible to adopt a mode (external determination method) using an optical determination system comprising a light source, such as laser light emitting element, and a photoreceptor element, whereby light, such as laser light, is irradiated onto the ink droplets ejected from the nozzles and the droplets in flight are determined by means of the transmitted light quantity (received light quantity).

The print controller 180 implements various corrections with respect to the print head 150, on the basis of the information obtained from the print determination unit 124 or another ejection determination device (not shown), according to requirements, and it implements control for carrying out cleaning operations (nozzle restoring operations), such as preliminary ejection, suctioning, or wiping, as and when necessary.

By means of the inkjet recording apparatus 110 of the present embodiment, it is possible to form images of high quality at high speed, using the print head 150 having a high density of nozzle rows.

In the present embodiment, the inkjet recording apparatus using a page-wide full line type head having a nozzle row of a length corresponding to the entire width of the recording medium has been described; however, the scope of application of the present invention is not limited to this, and the present invention may also be applied to an inkjet recording apparatus using a shuttle head which performs image recording while moving a short recording head back and forth reciprocally (by means of a plurality of scanning actions of the head).

Moreover, in the foregoing explanation, the inkjet recording apparatus has been described as one embodiment of a liquid image forming apparatus; however, the scope of application of the present invention is not limited to this. For example, the liquid ejection head according to the present invention may also be applied to a photographic image forming apparatus in which developing solution is applied onto a printing paper by means of a non-contact method. Furthermore, the scope of application of the liquid ejection head according to the present invention is not limited to image forming apparatuses, and the present invention may also be applied to various other types of apparatuses which spray a processing liquid, or other liquid, toward an ejection receiving medium by means of a liquid ejection head (such as a coating device, a liquid applying device, a wiring pattern printing device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head which ejects droplets of liquid from ejection ports by pressurizing the liquid filled in pressure chambers connected to the ejection ports, the liquid ejection head comprising:

a first substrate;

first conducting members which are formed in a column shape erecting on a surface of the first substrate in a direction substantially perpendicular to the surface of the first substrate;

second conducting members which have lower hardness than the first conducting members and are formed on ends of the first conducting members different than ends connecting with the surface of the first substrate, pairs of the first conducting members and the second conducting members composing column-shaped electrical wires;

a second substrate which is bonded to ends of the second conducting members different than ends connecting with the first conducting members; and pressure generating elements which are formed on one of the first substrate and the second substrate, the pressure generating elements being connected to the electrical wires and generating pressure change in the liquid inside the pressure chambers by being driven by drive signals applied through the electrical wires.

2. The liquid ejection head as defined in claim 1, wherein the second conducting members are formed from a material including one of copper, aluminum, silver, and gold.

3. The liquid ejection head as defined in claim 1, further comprising:

a common liquid chamber which is formed between the first substrate and the second substrate and accumulates the liquid to be supplied to the pressure chambers, wherein peripheral parts of the first conducting members and the second conducting members are coated with an insulating film.

4. The liquid ejection head as defined in claim 1, wherein the pressure generating elements comprise piezoelectric elements including piezoelectric bodies formed by spray deposition.

5. An image forming apparatus, comprising the liquid ejection head as defined in claim 1, which forms an image on a recording medium by the droplets of the liquid ejected from the ejection ports.

6. The liquid ejection head as defined in claim 1, wherein the pairs of the first conducting members and the second conducting members composing the column-shaped electrical wires, have different hardnesses and are stacked in layer.

7. The liquid ejection head as defined in claim 1, wherein the first conducting members erect on the surface of the first substrate in the direction perpendicular to the surface of the first substrate.

8. The liquid ejection head as defined in claim 1, wherein the first conducting members are made of a material that is different from a material of which the second conducting members are made.

9. The liquid ejection head as defined in claim 1, wherein:

the first conducting members and the second conducting members are made of a same material; and a speed V1 at which a powder of the material is blown on the surface of the first substrate so as to form the first conducting members by spray deposition is lower than a speed V2 at which powder of the material is blown on the ends of the first conducting members so as to form the second conducting members by spray deposition, in such a manner that the first conducting members have different hardness from the second conducting members.

10. The liquid ejection head as defined in claim 1, wherein a film height of the first conducting members is larger than a film height of the second conducting members.

11. The liquid ejection head as defined in claim 1, wherein the column-shaped electrical wires form a space of a common liquid chamber.

* * * * *